US008985984B2

(12) United States Patent
Ogata et al.

(10) Patent No.: US 8,985,984 B2
(45) Date of Patent: Mar. 24, 2015

(54) ROTARY COMPRESSOR AND REFRIGERATION CYCLE APPARATUS

(75) Inventors: Takeshi Ogata, Kyoto (JP); Atsuo Okaichi, Osaka (JP); Hiroshi Hasegawa, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 396 days.

(21) Appl. No.: 13/497,431

(22) PCT Filed: Jul. 6, 2011

(86) PCT No.: PCT/JP2011/003868

§ 371 (c)(1), (2), (4) Date: Mar. 21, 2012

(87) PCT Pub. No.: WO2012/004992

PCT Pub. Date: Jan. 12, 2012

(65) Prior Publication Data

US 2012/0174618 A1 Jul. 12, 2012

(30) Foreign Application Priority Data

Jul. 8, 2010 (JP) ..... 2010-156034

(51) Int. Cl.
*F04C 2/00* (2006.01)
*F04C 18/00* (2006.01)
(Continued)

(52) U.S. Cl.
CPC ..... *F04C 18/3564* (2013.01); *F04C 23/001* (2013.01); *F04C 23/008* (2013.01); *F04C 29/128* (2013.01)
USPC ..... 418/268; 418/209; 418/221; 418/222; 418/223; 418/236; 418/238; 418/241; 418/248

(58) Field of Classification Search
CPC ..... F04C 18/3564; F04C 23/008; F04C 21/0845; F04C 23/001; F25B 9/06
USPC ..... 418/221, 222, 223, 236, 238, 241, 248
See application file for complete search history.

(56) References Cited

U.S. PATENT DOCUMENTS 3,568,712 A 3/1971 Rinehart
3,797,975 A * 3/1974 Keller ..... 418/137
(Continued)

FOREIGN PATENT DOCUMENTS

CN 1904369 1/2007
CN 101560977 10/2009
(Continued)

*Primary Examiner* — Steve M Gravini
*Assistant Examiner* — Filip Zec
(74) *Attorney, Agent, or Firm* — Hamre, Schumann, Mueller & Larson, P.C.

(57) ABSTRACT

A rotary compressor (102) has a shaft (4), a cylinder (5), a piston (8), a first vane (32), a second vane (33), a first suction port (19), and a second suction port (20). The first vane (32) divides a space between the cylinder (5) and the piston (8) along a circumferential direction of the piston (8). The second vane (33) further divides the space divided by the first vane (32) along the circumferential direction of the piston (8) so that a first compression chamber (25) and a second compression chamber (26) having a smaller volume than the first compression chamber (25) are formed within the cylinder (5). The first suction port (19) introduces a working fluid into the first compression chamber (25). The second suction port (20) introduces a working fluid into the second compression chamber (26). The second suction port (20) is provided with a suction check valve (50).

16 Claims, 20 Drawing Sheets

A–A

(51) Int. Cl.

| | |
|---|---|
| ***F04C 23/00*** | (2006.01) |
| ***F04C 11/00*** | (2006.01) |
| ***F04C 15/00*** | (2006.01) |
| ***F04C 18/356*** | (2006.01) |
| ***F04C 29/12*** | (2006.01) |

(56) References Cited

U.S. PATENT DOCUMENTS

| | | | | |
|---|---|---|---|---|
| 4,459,090 | A * | 7/1984 | Maruyama et al. | 418/259 |
| 5,069,607 | A * | 12/1991 | Da Costa | 418/63 |
| 6,213,732 | B1 | 4/2001 | Fujio | |
| 7,048,525 | B2 | 5/2006 | Brick et al. | |
| 7,316,120 | B2 | 1/2008 | Aoki et al. | |
| 7,736,134 | B2 * | 6/2010 | Schneider | 418/26 |
| 2004/0005236 | A1 * | 1/2004 | Lee | 418/219 |
| 2006/0210418 | A1 * | 9/2006 | Bae et al. | 418/125 |
| 2007/0280843 | A1 * | 12/2007 | Bae et al. | 418/54 |
| 2008/0031756 | A1 * | 2/2008 | Hwang et al. | 418/1 |
| 2009/0241581 | A1 * | 10/2009 | Hasegawa et al. | 62/324.6 |
| 2010/0119396 | A1 | 5/2010 | Guo | |

FOREIGN PATENT DOCUMENTS

| | | |
|---|---|---|
| JP | 55-177090 | 12/1980 |
| JP | 59-066663 | 4/1984 |
| JP | 62-056781 | 4/1987 |
| JP | 3-053532 | 8/1991 |
| JP | 10-299680 | 11/1998 |
| JP | 2000-120572 | 4/2000 |
| JP | 2006-112753 | 4/2006 |
| JP | 2006-152950 | 6/2006 |

* cited by examiner

A–A

B-B

D–D

E–E

ROTARY COMPRESSOR AND REFRIGERATION CYCLE APPARATUS

TECHNICAL FIELD

The present invention relates to a rotary compressor and a refrigeration cycle apparatus.

BACKGROUND ART

It is known that the efficiency of a refrigeration cycle apparatus is increased by injecting a gas phase refrigerant having an intermediate pressure into a compressor (see Patent Literature 1). With this technique, since the work of the compressor and the pressure loss of the refrigerant in an evaporator can be reduced, the coefficient of performance (COP) of the refrigeration cycle is improved.

As a compressor that can be applied to the injection technique, a rolling piston compressor provided with a plurality of vanes (blades) so as to form a first compression chamber and a second compression chamber within a cylinder has been proposed (see Patent Literature 2).

FIG. 20 is a configuration diagram of a heat pump type heating apparatus described in FIG. 3 of Patent Literature 2. A heat pump type heating apparatus 500 includes a rolling piston compressor 501, a condenser 503, an expansion mechanism 504, a gas-liquid separator 507, and an evaporator 509, and is configured to compress a gas phase refrigerant from the evaporator 509 and an intermediate pressure gas phase refrigerant separated in the gas-liquid separator 507, respectively, in the compressor 501. Vanes 525 and 535 attached to a cylinder 522 of the compressor 501 divide the space between the cylinder 522 and a rotor 523 into a main compression chamber 526 and an auxiliary compression chamber 527. The main compression chamber 526 has a suction port 526*a* and a discharge port 526*b*. The auxiliary compression chamber 527 has a suction port 527*a* and a discharge port 527*b*. The suction port 526*a* is connected to the evaporator 509, and the suction port 527*a* is connected to the gas-liquid separator 507. The discharge port 526*b* and the discharge port 527*b* are merged together and connected to the condenser 503.

CITATION LIST

Patent Literature

Patent Literature 1 JP 2006-112753 A
Patent Literature 2 JP 03 (1991)-53532 B

SUMMARY OF INVENTION

Technical Problem

The present inventors have studied in detail the heat pump type heating apparatus 500 described in Patent Literature 2 to determine whether it can be practically used. As a result, they have ascertained that the compressor 501 has the following technical problems. When the compressor 501 shifts from a suction process to a compression process, a large amount of refrigerant flows back into the suction port 527*a* from the auxiliary compression chamber 527. This causes a significant decrease in compressor efficiency. Therefore, even if the compressor 501 described in Patent Literature 2 is used to construct a refrigeration cycle apparatus, an increase in the COP of the refrigeration cycle cannot be expected.

It is an object of the present invention to improve a rotary compressor that can be applied to the injection technique.

Solution to Problem

The present invention provides a rotary compressor including: a cylinder; a piston disposed within the cylinder so as to form a space between the piston itself and the cylinder; a shaft to which the piston is fitted; a first vane for dividing the space along a circumferential direction of the piston, the first vane being attached to the cylinder at a first angular position along a rotation direction of the shaft; a second vane for further dividing the space divided by the first vane along the circumferential direction of the piston so that a first compression chamber and a second compression chamber having a smaller volume than the first compression chamber are formed within the cylinder, the second vane being attached to the cylinder at a second angular position along the rotation direction of the shaft; a first suction port for introducing a working fluid to be compressed in the first compression chamber into the first compression chamber; a first discharge port for discharging the working fluid compressed in the first compression chamber outside the first compression chamber from the first compression chamber; a second suction port for introducing the working fluid to be compressed in the second compression chamber into the second compression chamber; a second discharge port for discharging the working fluid compressed in the second compression chamber outside the second compression chamber from the second compression chamber; and a suction check valve provided in the second suction port.

In another aspect, the present invention provides a refrigeration cycle apparatus including: the rotary compressor of the present invention; a radiator for cooling the working fluid compressed in the rotary compressor; an expansion mechanism for expanding the working fluid cooled in the radiator; a gas-liquid separator for separating the working fluid expanded in the expansion mechanism into a gas phase working fluid and a liquid phase working fluid; an evaporator for evaporating the liquid phase working fluid separated in the gas-liquid separator; a suction flow path for introducing the working fluid that has flowed out of the evaporator into the first suction port of the rotary compressor; and an injection flow path for introducing the gas phase working fluid separated in the gas-liquid separator into the second suction port of the rotary compressor.

Advantageous Effects of Invention

The rotary compressor of the present invention has a cylinder and a plurality of vanes attached to the cylinder. The plurality of vanes divide the space between the cylinder and a piston, and thereby, a first compression chamber and a second compression chamber are formed within the cylinder. The second compression chamber has a smaller volume than the first compression chamber. The first compression chamber can be used as a main compression chamber. The second compression chamber can be used as a compression chamber for compressing a working fluid injected into the rotary compressor.

The working fluid is introduced into the second compression chamber through a second suction port. The second suction port is provided with a suction check valve. With this valve, it is possible to prevent the working fluid drawn into the second compression chamber from flowing back outside the second compression chamber through the second suction port. Therefore, the rotary compressor of the present invention can achieve a high compressor efficiency. A refrigeration cycle apparatus using the rotary compressor of the present invention can enjoy the benefit of a high injection effect.

DESCRIPTION OF EMBODIMENTS

Hereinafter, embodiments of the present invention will be described with reference to the accompanying drawings. The present invention is not limited by the embodiments described below. The embodiments and modifications can be combined with one another, without departing from the spirit and scope of the invention.

First Embodiment

Figure 1:
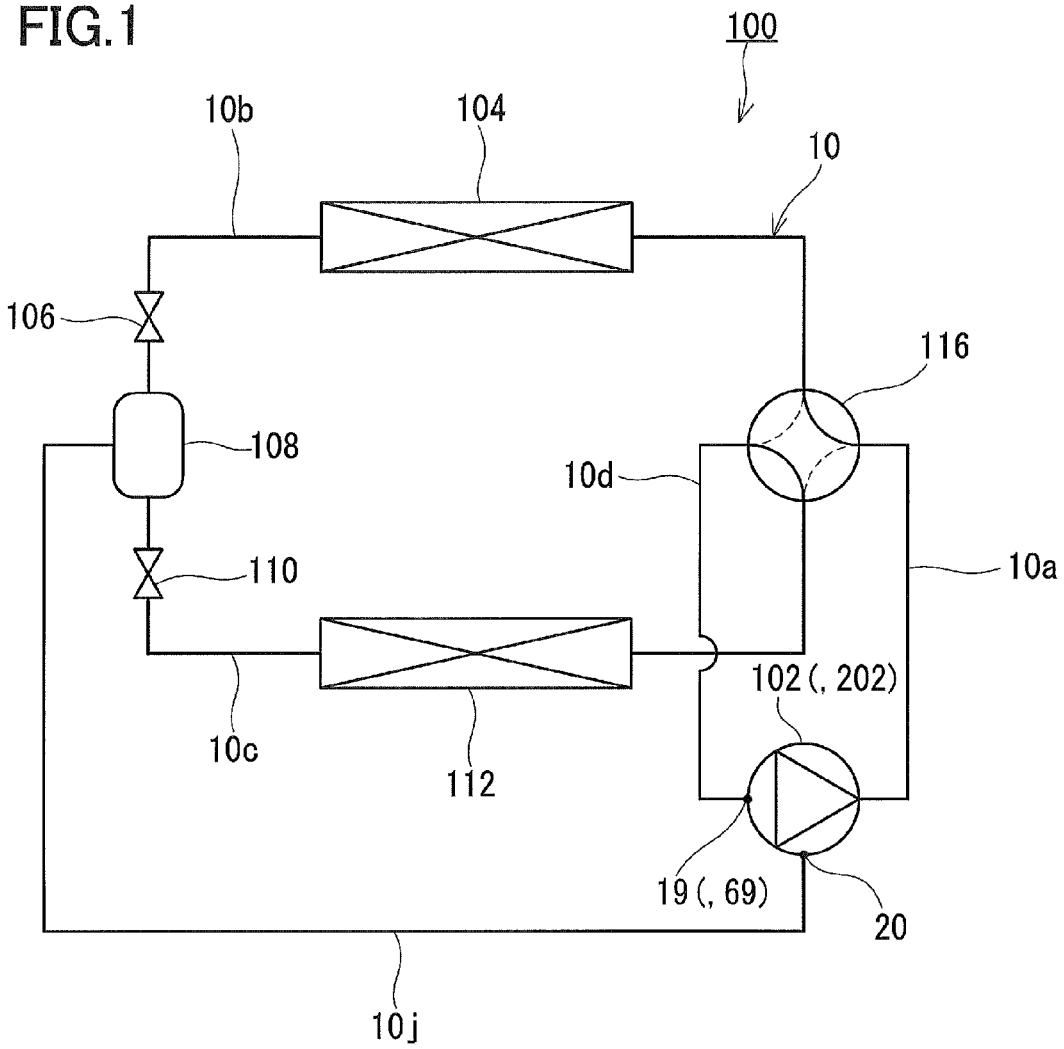
FIG. 1 is a configuration diagram of a refrigeration cycle apparatus according to a first embodiment of the present invention.

FIG. 1 is a configuration diagram of a refrigeration cycle apparatus according to the present embodiment. A refrigeration cycle apparatus 100 includes a rotary compressor 102, a first heat exchanger 104, a first expansion mechanism 106, a gas-liquid separator 108, a second expansion mechanism 110, and a second heat exchanger 112. These components are connected in a loop in this order by flow paths 10*a* to 10*d* so as to form a refrigerant circuit 10. The flow paths 10*a* to 10*d* are typically constituted by refrigerant pipes. The refrigerant circuit 10 is filled with a refrigerant, such as hydrofluorocarbon or carbon dioxide, as a working fluid.

The refrigeration cycle apparatus 100 further includes an injection flow path 10*j*. The injection flow path 10*j* has one end connected to the gas-liquid separator 108 and the other end connected to the rotary compressor 102, and introduces a gas phase refrigerant separated in the gas-liquid separator 108 directly into the rotary compressor 102. The injection flow path 10*j* is typically constituted by a refrigerant pipe. A pressure reducing valve may be provided in the injection flow path 10*j*. An accumulator may be provided in the injection flow path 10*j*.

A four-way valve 116, as a switching mechanism capable of switching the flow direction of the refrigerant, is provided in the refrigerant circuit 10. When the four-way valve 116 is controlled as indicated by solid lines in FIG. 1, the refrigerant compressed in the rotary compressor 102 is supplied to the first heat exchanger 104. In this case, the first heat exchanger 104 functions as a radiator (condenser) for cooling the refrigerant compressed in the rotary compressor 102. The second heat exchanger 112 functions as an evaporator for evaporating a liquid phase refrigerant separated in the gas-liquid separator 108. On the other hand, when the four-way valve 116 is controlled as indicated by dashed lines in FIG. 1, the refrigerant compressed in the rotary compressor 102 is supplied to the second heat exchanger 112. In this case, the first heat exchanger 104 functions as an evaporator and the second heat exchanger 112 functions as a radiator. The four-way valve 116 allows, for example, an air conditioner using the refrigeration cycle apparatus 100 to have both cooling and heating functions.

The rotary compressor 102 is a device for compressing the refrigerant to a high temperature and high pressure state. The rotary compressor 102 has a first suction port 19 (main suction port) and a second suction port 20 (injection suction port). The flow path 10*d* is connected to the first suction port 19 so that the refrigerant that has flowed out of the first heat exchanger 104 or the second heat exchanger 112 is introduced into the rotary compressor 102. The injection path 10*j* is connected to the second suction port 20 so that the gas refrigerant separated in the gas-liquid separator 108 is introduced into the rotary compressor 102.

The first heat exchanger 104 is typically constituted by an air-refrigerant heat exchanger or a water-refrigerant heat exchanger. The second heat exchanger 112 also is typically constituted by an air-refrigerant heat exchanger or a water-refrigerant heat exchanger. When the refrigeration cycle apparatus 100 is used for an air conditioner, both the first heat exchanger 104 and the second heat exchanger 112 are constituted by air-refrigerant heat exchangers. When the refrigeration cycle apparatus 100 is used for a water heater or a hot water heater, the first heat exchanger 104 is constituted by a water-refrigerant heat exchanger, and the second heat exchanger 112 is constituted by an air-refrigerant heat exchanger.

The first expansion mechanism 106 and the second expansion mechanism 110 are devices for expanding the refrigerant cooled in the first heat exchanger 104 (or the second heat exchanger 112) as a radiator or the liquid phase refrigerant separated in the gas-liquid separator 108. The first expansion mechanism 106 and the second expansion mechanism 110 are typically constituted by expansion valves. A preferred expansion valve is an opening adjustable valve, such as, for example, an electronic expansion valve. The first expansion mechanism 106 is provided in the flow path 10*b* between the first heat exchanger 104 and the gas-liquid separator 108. The second expansion mechanism 110 is provided in the flow path 10*c* between the gas-liquid separator 108 and the second heat exchanger 112. The expansion mechanisms 106 and 110 each may be constituted by a positive displacement expander capable of recovering power from the refrigerant.

The gas-liquid separator 108 separates the refrigerant expanded in the first expansion mechanism 106 or the second expansion mechanism 110 into a gas phase refrigerant and a liquid phase refrigerant. The gas-liquid separator 108 is provided with an inlet for the refrigerant expanded in the first expansion mechanism 106 or the second expansion mechanism 110, an outlet for the liquid phase refrigerant, and an outlet for the gas phase refrigerant. One end of the injection flow path 10*j* is connected to the outlet for the gas phase refrigerant.

Other devices such as an accumulator and an internal heat exchanger may be provided in the refrigerant circuit 10.

Figure 2:
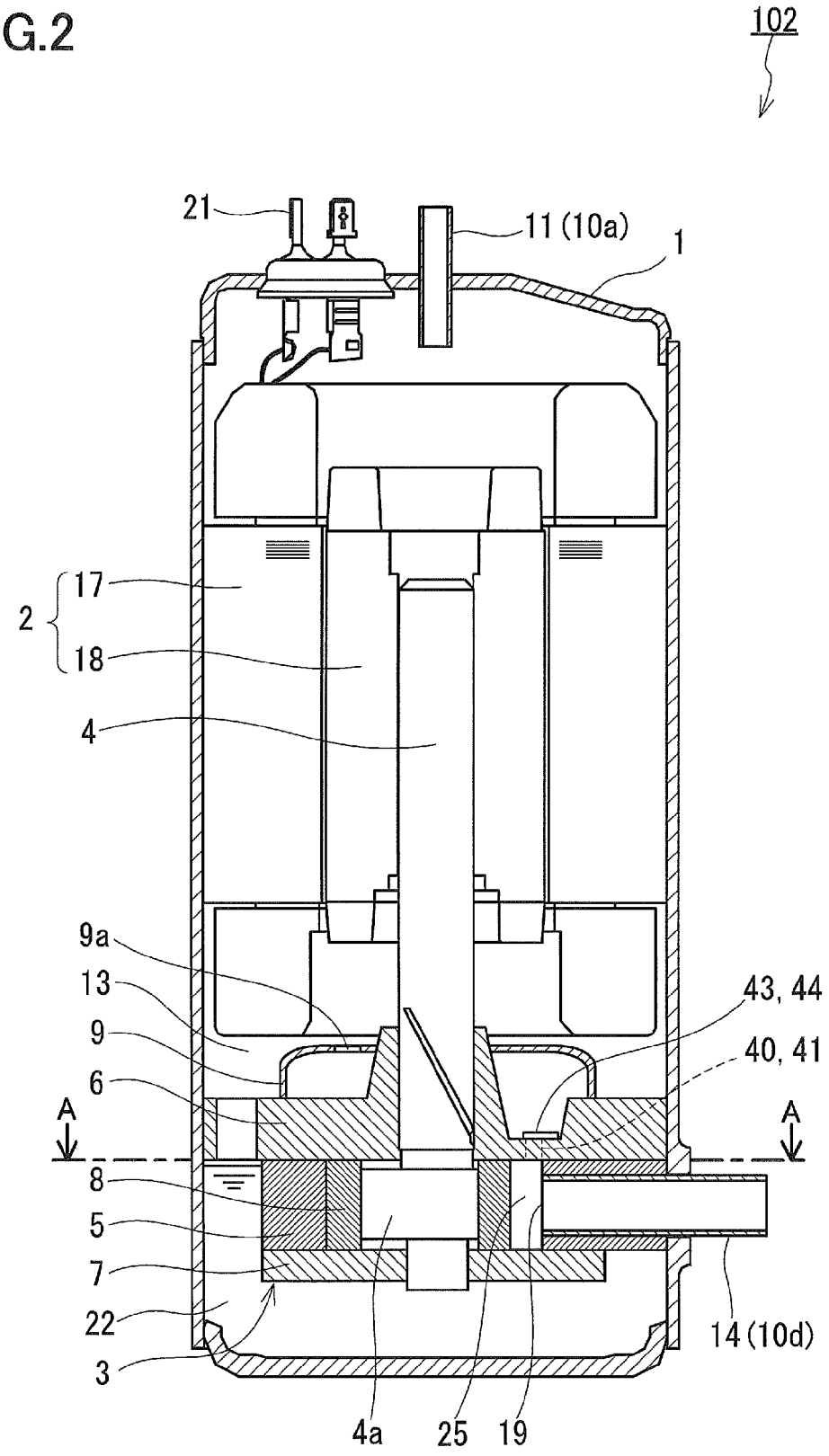
FIG. 2 is a longitudinal cross-sectional view of a rotary compressor used in the refrigeration cycle apparatus shown in FIG. 1.
Figure 3:
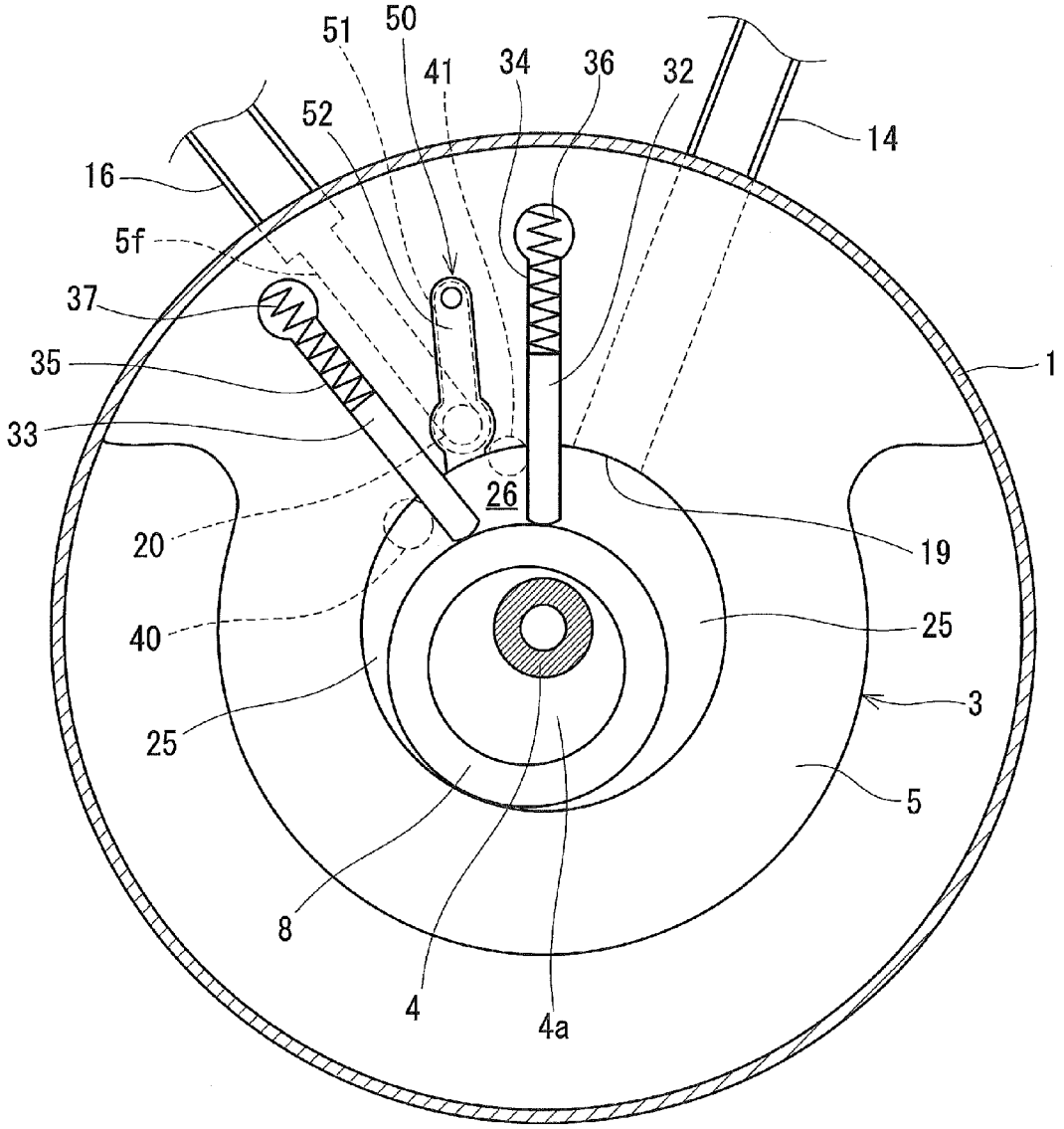
FIG. 3 is a transverse cross-sectional view of the rotary compressor shown in FIG. 2, taken along the line A-A.

FIG. 2 is a longitudinal cross-sectional view of the rotary compressor 102 used in the refrigeration cycle apparatus 100 shown in FIG. 1. FIG. 3 is a transverse cross-sectional view of the rotary compressor 102 shown in FIG. 2, taken along the line A-A. The rotary compressor 102 includes a closed casing 1, a motor 2, a compression mechanism 3, and a shaft 4. The compression mechanism 3 is disposed in the lower part of the closed casing 1. The motor 2 is disposed above the compression mechanism 3 in the closed casing 1. The compression mechanism 3 and the motor 2 are coupled by the shaft 4. A terminal 21 for supplying electric power to the motor 2 is provided on the top of the closed casing 1. An oil reservoir 22 for holding lubricating oil is formed in the bottom of the closed casing 1.

The motor 2 is constituted by a stator 17 and a rotor 18. The stator 17 is fixed to the inner wall of the closed casing 1. The rotor 18 is fixed to the shaft 4 and rotates together with the shaft 4.

A discharge pipe 11 is provided in the top wall of the closed casing 1. The discharge pipe 11 penetrates the top wall of the closed casing 1 and opens into an internal space 13 of the closed casing 1. The discharge pipe 11 serves as a discharge flow path for discharging the refrigerant compressed in the compression mechanism 3 outside the closed casing 1. That is, the discharge pipe 11 constitutes a part of the flow path 10*a* shown in FIG. 1. During the operation of the rotary compressor 102, the internal space 13 of the closed casing 1 is filled with the compressed refrigerant. That is, the rotary compressor 102 is a high-pressure shell type compressor. In the high-pressure shell type rotary compressor 102, since the motor 2 can be cooled by the refrigerant, an increase in the motor efficiency can be expected. When the refrigerant is heated by the motor 2, the heating capability of the refrigeration cycle apparatus 100 also is increased.

The compression mechanism 3 is driven by the motor 2 to compress the refrigerant. As shown in FIG. 2 and FIG. 3, the compression mechanism 3 has a cylinder 5, a main bearing 6, an auxiliary bearing 7, a piston 8, a muffler 9, a first vane 32, a second vane 33, a first discharge valve 43, a second discharge valve 44, and a suction check valve 50. In the present embodiment, only the second suction port 20 of the first and second suction ports 19 and 20 is provided with the suction check valve 50.

The shaft 4 has an eccentric portion 4*a* projecting outwardly in a radial direction. The piston 8 is disposed within the cylinder 5. Within the cylinder 5, the piston 8 is fitted to the eccentric portion 4*a* of the shaft 4. A first vane groove 34 and a second vane groove 35 are formed in the cylinder 5. The first vane groove 34 is formed at a first angular position along the rotation direction of the shaft 4. The second vane groove 35 is formed at a second angular position along the rotation direction of the shaft 4.

A first vane 32 (blade) having a tip in contact with the outer peripheral surface of the piston 8 is slidably fitted in the first vane groove 34. The first vane 32 divides the space between the cylinder 5 and the piston 8 along the circumferential direction of the piston 8. A second vane 33 (blade) having a tip in contact with the outer peripheral surface of the piston 8 is slidably fitted in the second vane groove 35. The second vane 33 further divides the space between the cylinder 5 and the piston 8 along the circumferential direction of the piston 8. Thereby, a first compression chamber 25 (main compression chamber) and a second compression chamber 26 (injection compression chamber) having a smaller volume than the first compression chamber 25 are formed within the cylinder 5.

The piston 8 and one selected from the first vane 32 and the second vane 33 may be constituted by a single component, i.e., a so-called swing piston. One selected from the first vane 32 and the second vane 33 may be coupled to the piston 8.

A first spring 36 is disposed behind the first vane 32. A second spring 37 is disposed behind the second vane 37. The first spring 36 and the second spring 37 press the first vane 32 and the second vane 33, respectively, toward the center of the shaft 4. The rear end of the first vane groove 34 and the rear end of the second vane groove 35 are each in communication with the internal space 13 of the closed casing 1. Therefore, the pressure in the internal space 13 of the closed casing 1 is applied to the rear surface of the first vane 32 and the rear surface of the second vane 33. Lubricating oil stored in the oil reservoir 22 is supplied to the first vane groove 34 and the second vane groove 35.

In the present description, the position of the first vane 32 and the first vane groove 34 is defined as a position of "0 degrees (a first angle)" along the rotation direction of the shaft 4. In other words, the rotation angle of the shaft 4 at the moment when the first vane 32 is pushed all the way into the first vane groove 34 by the piston 8 is defined as "0 degrees". The rotation angle of the shaft 4 at the moment when the second vane 33 is pushed all the way into the second vane groove 35 by the piston 8 corresponds to "a second angle". In the present embodiment, the angle θ (degrees) from the first angular position where the first vane 32 is disposed to the second angular position where the second vane 33 is disposed is, for example, in the range of 270 to 350 degrees in the rotation direction of the shaft 4. In other words, the angle (360-θ) between the first vane 32 and the second vane 33 is in the range of 10 to 90 degrees. When the angle θ is 270 degrees or more, the amount of refrigerant flowing back into the first suction pipe 14 from the first compression chamber 25 through the first suction port 19 is small enough for the suction process of the first compression chamber 25. Therefore, there is no need to provide a check valve in the first suction port 19.

As shown in FIG. 2, the main bearing 6 and the auxiliary bearing 7 are disposed on and beneath the cylinder 5 to close the cylinder 5. The muffler 9 is provided on the main bearing 6 and covers the first discharge valve 43 and the second discharge valve 44. A discharge port 9*a* for discharging the compressed refrigerant to the internal space 13 of the closed casing 1 is formed in the muffler 9. The shaft 4 penetrates the central portion of the muffler 9 and is rotatably supported by the main bearing 6 and the auxiliary bearing 7.

As shown in FIG. 2 and FIG. 3, in the present embodiment, the first suction port 19 and the second suction port 20 are formed in the cylinder 5. The first suction port 19 introduces the refrigerant to be compressed in the first compression chamber 25 into the first compression chamber 25. The second suction port 20 introduces the refrigerant to be compressed in the second compression chamber 26 into the second compression chamber 26. The first suction port 19 and the second suction port 20 may each be formed in the main bearing 6 or the auxiliary bearing 7.

In the present embodiment, the second suction port 20 has a smaller opening area than the first suction port 19. The smaller the opening area of the second suction port 20 is, the smaller the sizes of the parts of the suction check valve 50 are. This is important in suppressing an increase in dead volume caused by the suction check valve 50 and in providing a design margin. When the opening area of the first suction port 19 is $S_1$ and the opening area of the second suction port 20 is $S_2$, the opening areas $S_1$ and $S_2$ satisfy, for example, $1.1 \leq (S_1/S_2) \leq 30$. The "dead volume" refers to the volume that does not serve as a working chamber. Generally, a large dead volume is not preferable for a positive displacement fluid machine.

As shown in FIG. 3, the first suction pipe 14 (main suction pipe) and the second suction pipe 16 (injection suction pipe) are connected to the compression mechanism 3. The first suction pipe 14 is fitted in the cylinder 5 through the barrel portion of the closed casing 1 so as to supply the refrigerant to the first suction port 19. The first suction pipe 14 constitutes a part of the flow path 10*d* shown in FIG. 1. The second suction pipe 16 is fitted in the cylinder 5 through the barrel portion of the closed casing 1 so as to supply the refrigerant to the second suction port 20. The second suction pipe 16 constitutes a part of the injection flow path 10*j* shown in FIG. 1.

The compression mechanism 3 further is provided with a first discharge port 40 (main discharge port) and a second discharge port 41 (injection discharge port). The first discharge port 40 and the second discharge port 41 are each formed in the main bearing 6 in a manner as to penetrate the main bearing 6 in the axial direction of the shaft 4. The first discharge port 40 discharges the refrigerant compressed in the first compression chamber 25 outside the first compression chamber 25 (into the internal space of the muffler 9 in the present embodiment) from the first compression chamber 25. The second discharge port 41 discharges the refrigerant compressed in the second compression chamber 26 outside the second compression chamber 26 (into the internal space of the muffler 9 in the present embodiment) from the second compression chamber 26. The first discharge port 40 and the second discharge port 41 are provided with a first discharge valve 43 and a second discharge valve 44 respectively. When the pressure in the first compression chamber 25 exceeds the pressure in the internal space 13 of the closed casing 1 (high pressure of the refrigeration cycle), the first discharge valve 43 opens. When the pressure in the second compression chamber 26 exceeds the pressure in the internal space 13 of the closed casing 1, the second discharge valve 44 opens.

The muffler 9 serves as a discharge flow path connecting the internal space 13 of the closed casing 1 and each of the first discharge port 40 and the second discharge port 41. The refrigerant discharged outside the first compression chamber 25 through the first discharge port 40 and the refrigerant discharged outside the second compression chamber 26 through the second discharge port 41 are merged together in the muffler 9. The merged refrigerant flows into the discharge pipe 11 through the internal space 13 of the closed casing 1. The motor 2 is disposed in the closed casing 1 to be located in the flow path of the refrigerant from the muffler 9 to the discharge pipe 11. With such a configuration, efficient cooling of the motor 2 by the refrigerant and efficient heating of the refrigerant by the heat of the motor 2 can be achieved.

In the present embodiment, the second discharge port 41 has a smaller opening area than the first discharge port 40. The smaller the opening area of the second discharge port 41 is, the more the dead volume caused by the second discharge port 41 can be reduced. When the opening area of the first discharge port 40 is $S_3$ and the opening area of the second discharge port 41 is $S_4$, the opening areas $S_3$ and $S_4$ satisfy, for example, $1.1 \leq (S_3/S_4) \leq 15$.

The opening area $S_2$ of the second suction port 20 may be equal to the opening area $S_1$ of the first suction port 19 in some cases. Furthermore, the opening area $S_4$ of the second discharge port 41 may be equal to the opening area $S_3$ of the first discharge port 40 in some cases. The size of each of the suction ports and the discharge ports should be determined appropriately in view of the flow rate of the refrigerant at that port. More specifically, the size should be determined in view of the balance between the dead volume and the pressure loss.

Figure 4:
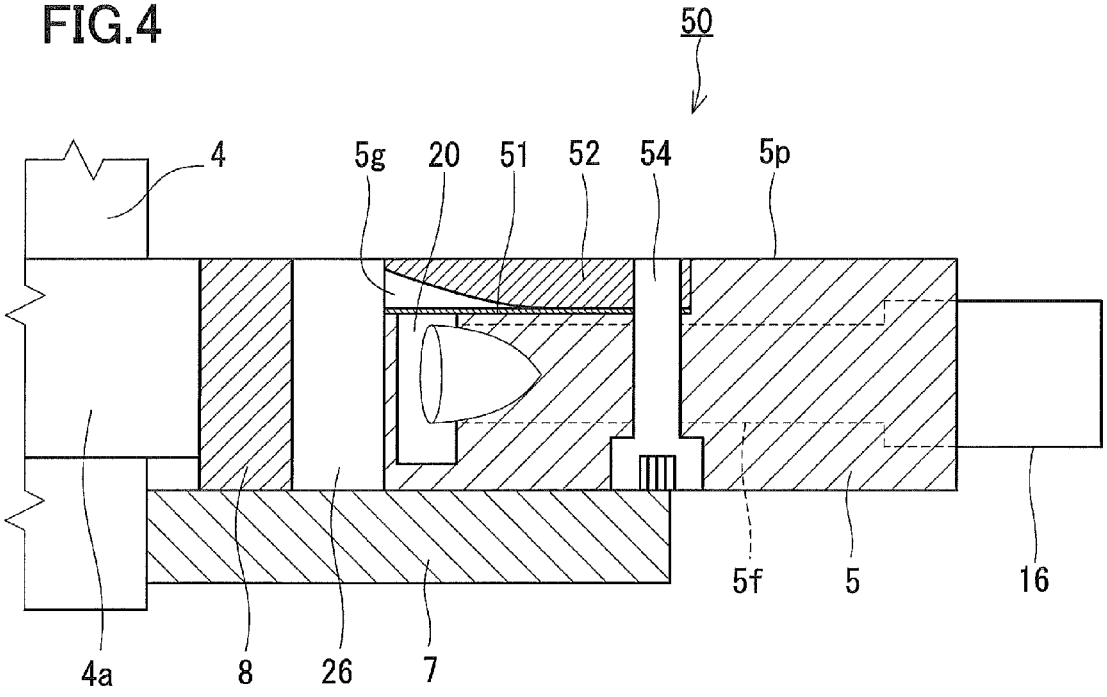
FIG. 4 is an enlarged cross-sectional view of a suction check valve.

As shown in FIG. 4, the suction check valve 50 includes a valve body 51 and a valve stopper 52. A shallow groove 5*g* having a strip shape in plan view is formed on the top surface 5*p* of the cylinder 5, and the valve body 51 and the valve stopper 52 are fitted in the groove 5*g*. The groove 5*g* extends outwardly in a radial direction of the cylinder 5 and is in communication with the second compression chamber 26. The second suction port 20 opens into the bottom of the groove 5*g*. Specifically, the second suction port 20 is constituted by a closed-end hole formed in the cylinder 5, and the other end of the hole opens into the bottom of the groove 5*g*. In the cylinder 5, a suction flow path 5*f* extending from the outer peripheral surface of the cylinder 5 to the center thereof is formed so as to supply the refrigerant to the second suction port 20. The suction pipe 16 is connected to the suction flow path 5*f*.

Figure 5A:
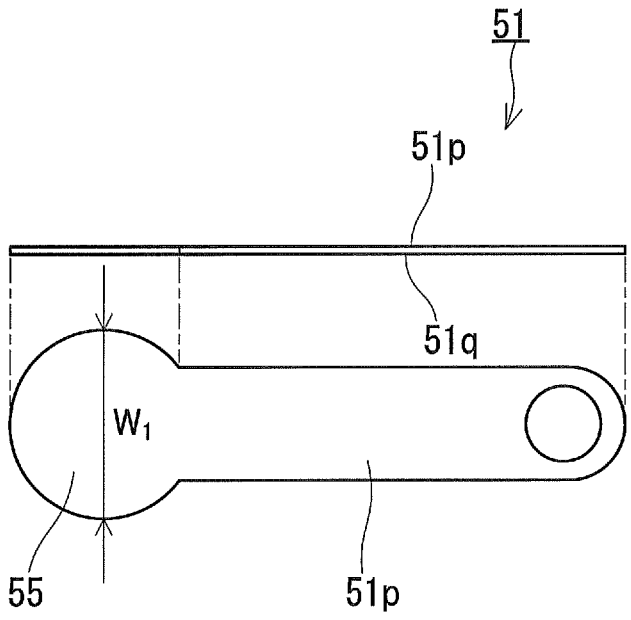
FIG. 5A shows side and plan views of a valve body.

As shown in FIG. 5A, the valve body 51 has a back surface 51*q* for closing the second suction port 20 and a front surface 51*p* to be exposed to the atmosphere in the second compression chamber 26 when the second suction port 20 is closed. The range of movement of the valve body 51 of the suction check valve 50 is determined in the second compression chamber 26. The valve body 51 has a thin plate shape as a whole. Typically, the valve body 51 is constituted by a thin metal plate (reed valve).

Figure 5B:
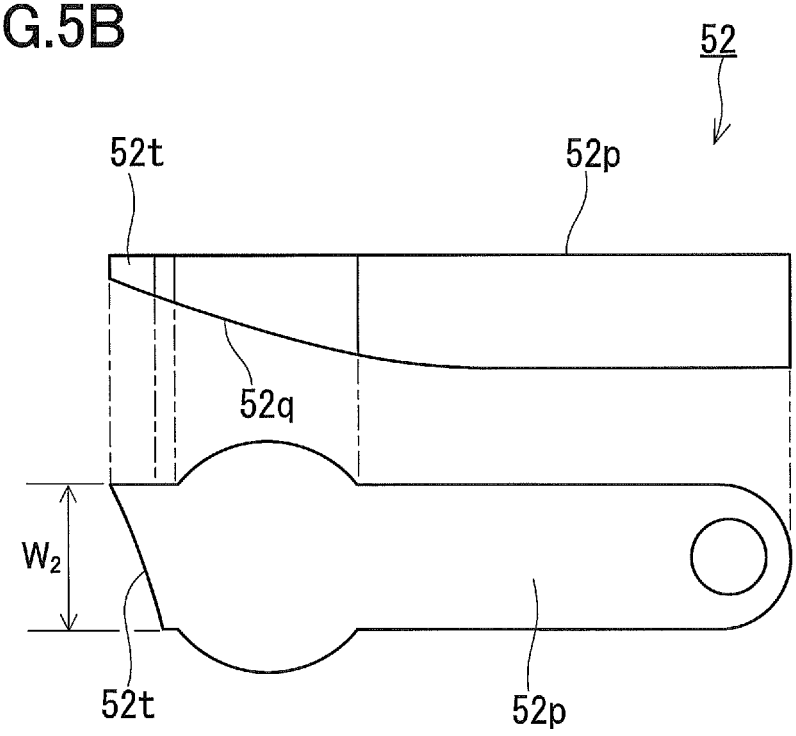
FIG. 5B shows side and plan views of a valve stopper.

As shown in FIG. 5B, the valve stopper 52 has a supporting surface 52*q* for limiting the amount of displacement of the valve body 51 in the thickness direction thereof when the second suction port 20 is opened. The supporting surface 52*q* forms a slightly curved surface so that the thickness of the valve stopper 52 decreases as it approaches the second compression chamber 26. That is, the valve stopper 52 has a shoetree-like shape as a whole. The front end surface 52*t* of the valve stopper 52 has a shape of a circular arc having the same radius of curvature as the inner radius of the cylinder 5.

The valve body 51 is disposed in the groove 5*g* so as to open and close the second suction port 20. The valve stopper 52 is disposed in the groove 5*g* so that the supporting surface 52*q* is exposed to the atmosphere in the second compression chamber 26 when the valve body 51 closes the second suction port 20. The valve body 51 and the valve stopper 52 are fixed to the cylinder 5 by a fastening member 54 such as a bolt. The rear end of the valve body 51 cannot move between the valve stopper 52 and the groove 5*g*, but the front end of the valve body 51 is not fixed and can swing. In a plan view of the valve stopper 52 and the second suction port 20, the second suction port 20 and the supporting surface 52*q* of the valve stopper 52 lie on top of each other.

The total thickness of the valve body 51 and the valve stopper 52 near the rear end of the valve stopper 52 is almost equal to the depth of the groove 5*g*. When the valve body 51 and the valve stopper 52 are fitted into the groove 5*g*, the level of the top surface 52*p* of the valve stopper 52 coincides with that of the cylinder 5 in the thickness direction of the cylinder 5.

As shown in FIG. 5A, the valve body 51 has a widened portion 55 for opening and closing the second suction port 20. The maximum width $W_1$ of the widened portion 55 is greater than the width $W_2$ of the front end of the valve stopper 52, in other words, greater than the width of the groove 5*g* at a position where it faces the cylinder 5. With the widened portion 55, an increase in the dead volume can be suppressed while the seal width for closing the second suction port 20 is secured.

Figure 6:
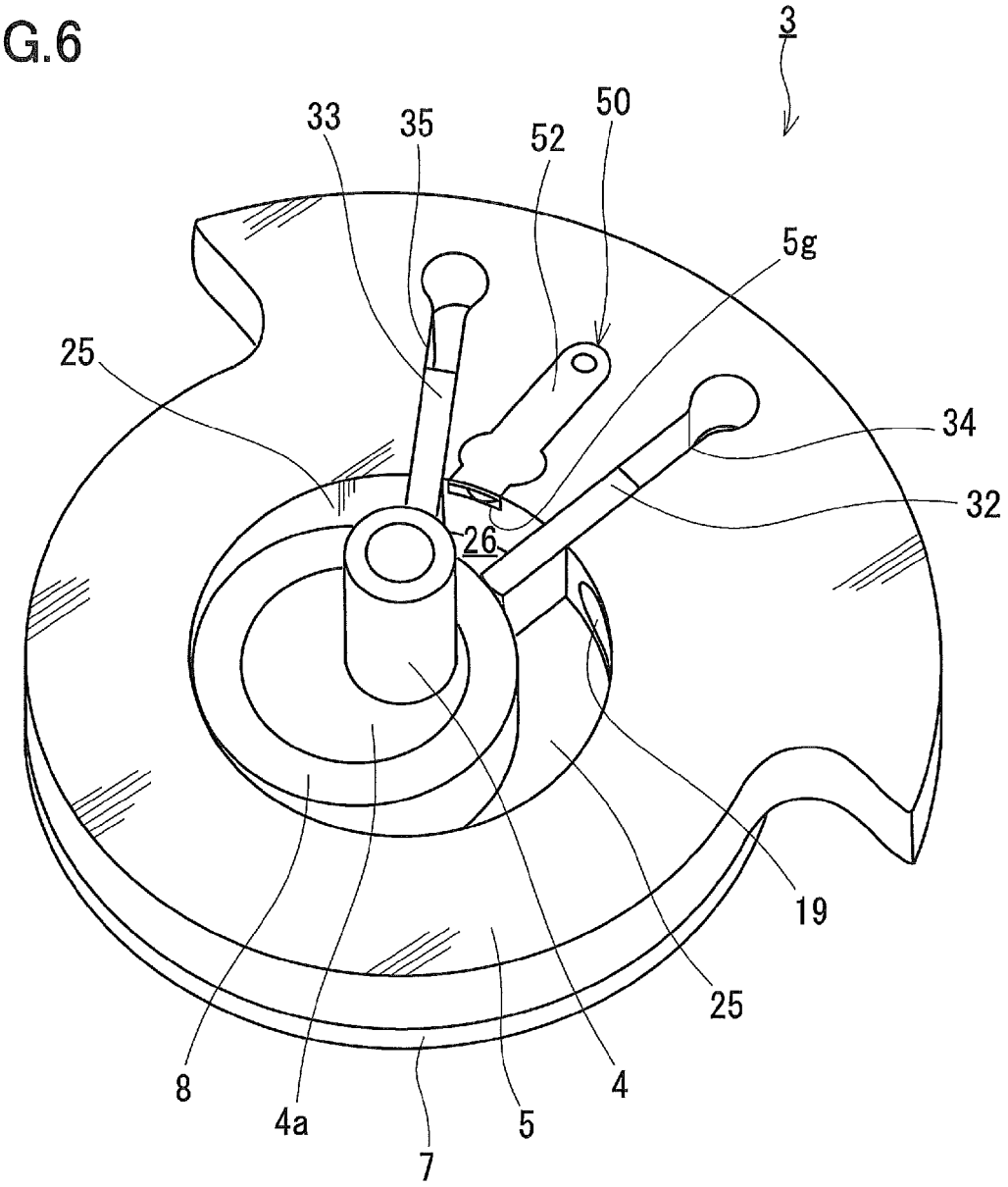
FIG. 6 is a perspective view of a compression mechanism.

As shown in FIG. 4 and FIG. 6, the depth of the groove 5*g* is, for example, smaller than a half of the thickness of the cylinder 5. The valve stopper 52 occupies a large part of the groove 5*g*. Only a small part of the groove 5*g* remains as the range of movement of the valve body 51.

The suction check valve 50 operates in the following manner as the shaft 5 rotates. When the pressure in the second compression chamber 26 falls below the pressure in the suction flow path 5*f* and the second suction pipe 16, the valve body 51 is displaced to conform to the shape of the supporting surface 52*q* of the valve stopper 52. In other words, the valve body 51 is pushed up. Thereby, the second suction port 20 is brought into communication with the second compression chamber 26, so that the refrigerant is supplied to the second compression chamber 26 through the second suction port 20. On the other hand, when the pressure in the second compression chamber 26 exceeds the pressure in the suction flow path 5*f* and the second suction pipe 16, the valve body 51 returns to its original flat shape. Thereby, the second suction port 20 is closed. Therefore, it is possible to prevent the refrigerant drawn into the second compression chamber 26 from flowing back to the suction flow path 5*f* and the second suction pipe 16 through the second suction port 20.

With the structural features of the suction check valve 50 of the present embodiment described above, it is possible to suppress an increase in dead volume caused by the presence of a check valve in the suction port. That is, the suction check valve 50 contributes to a high compressor efficiency. Accordingly, the refrigeration cycle apparatus 100 using the rotary compressor 102 of the present embodiment has a high COP.

The second suction port 20 may be formed in the main bearing 6 or the auxiliary bearing 7. In this case, the suction check valve 50 having the structure described with reference to FIG. 3 to FIG. 6 can be provided in the main bearing 6 or the auxiliary bearing 7. A member (closing member) for closing the cylinder 5 may be provided between the main bearing 6 (or the auxiliary bearing 7) and the cylinder 5. The suction check valve 50 may be provided in that member.

Figure 7:
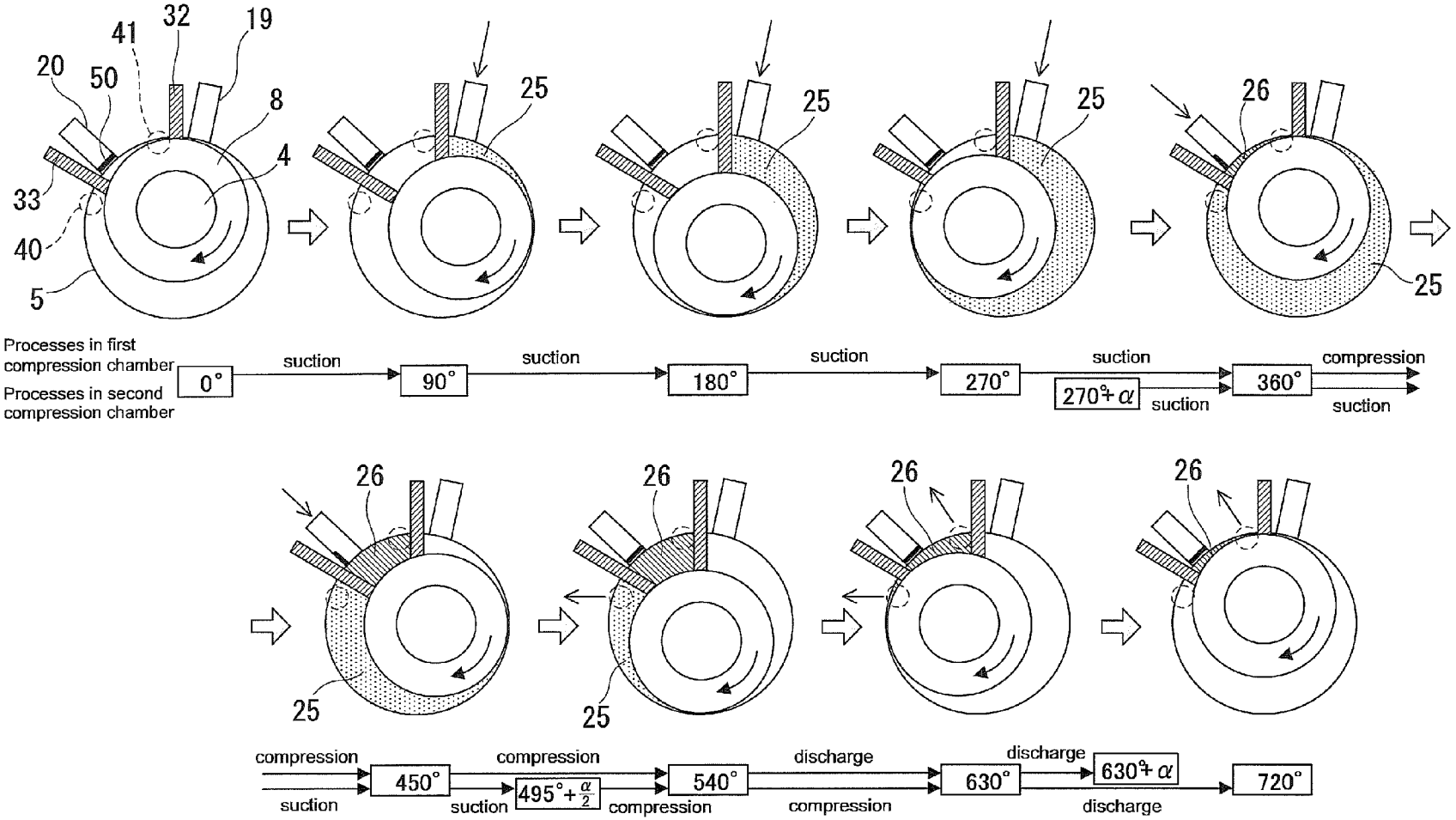
FIG. 7 is a schematic diagram showing the operation of the rotary compressor with the rotation angle of a shaft.

Next, the operation of the rotary compressor 102 is described in time series with reference to FIG. 7. The angles in FIG. 7 represent the rotation angles of the shaft 4. The angles shown in FIG. 7 are merely examples, and each process does not always start or end at the angle shown in FIG. 7. A suction process of drawing the refrigerant into the first compression chamber 25 starts when the shaft 4 has a rotation angle of 0 degrees and takes place until the shaft 4 has a rotation angle of approximately 360 degrees. The refrigerant drawn into the first compression chamber 25 is compressed as the shaft 4 rotates. The compression process continues until the pressure in the first compression chamber 25 exceeds the pressure in the internal space 13 of the closed casing 1. In FIG. 7, the compression process starts when the shaft 4 has a rotation angle of 360 degrees and takes place until the shaft 4 has a rotation angle of 540 degrees. A process of discharging the compressed refrigerant outside the first compression chamber 25 takes place until the point of contact between the cylinder 5 and the piston 8 passes the first discharge port 40. In FIG. 7, the discharge process starts when the shaft 4 has a rotation angle of 540 degrees and takes place until the shaft 4 has a rotation angle of $(630+\alpha)$ degrees. "$\alpha$" denotes an angle between the angular position of 270 degrees and the second angular position where the second vane 33 is disposed.

On the other hand, a suction process of drawing the refrigerant into the second compression chamber 26 starts when the shaft 4 has a rotation angle of $(270+\alpha)$ degrees and takes place until the shaft 4 has a rotation angle of $(495+\alpha/2)$ degrees. $(495+\alpha/2)$ is a rotation angle of the shaft 4 at which the second compression chamber 26 has a maximum volume. The refrigerant drawn into the second compression chamber 26 is compressed as the shaft 4 rotates. The compression process continues until the pressure in the second compression chamber 26 exceeds the pressure in the internal space 13 of the closed casing 1. In FIG. 7, the compression process starts when the shaft 4 has a rotation angle of $(495+\alpha/2)$ degrees and takes place until the shaft 4 has a rotation angle of 630 degrees. A process of discharging the compressed refrigerant outside the second compression chamber 26 takes place until the point of contact between the cylinder 5 and the piston 8 passes the second discharge port 41. In FIG. 7, the discharge process starts when the shaft 4 has a rotation angle of 630 degrees and takes place until the shaft 4 has a rotation angle of 720 degrees.

Figure 8A:
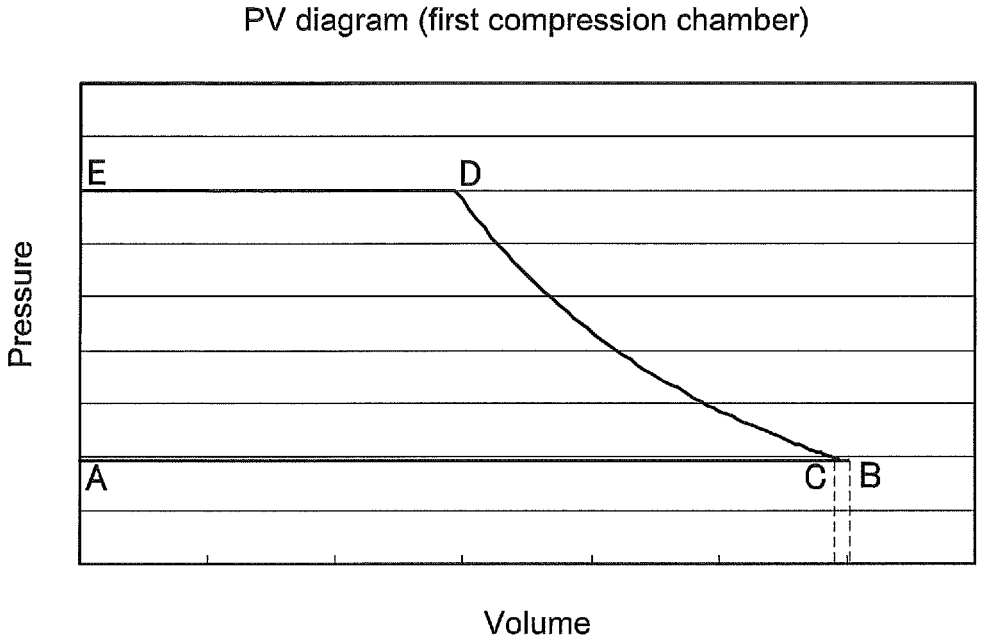
FIG. 8A is a PV diagram of a first compression chamber.
Figure 8B:
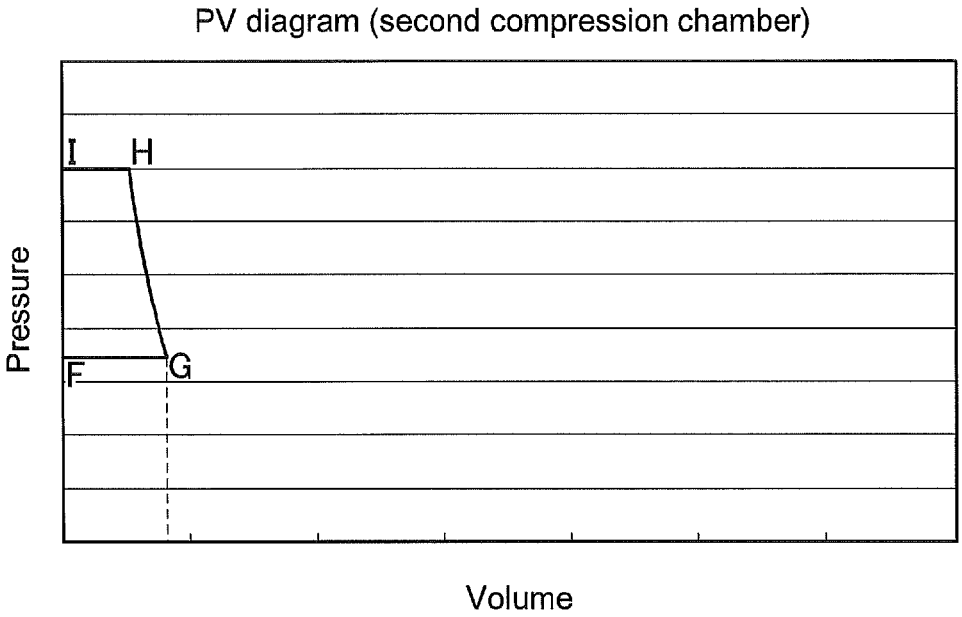
FIG. 8B is a PV diagram of a second compression chamber.

FIG. 8A and FIG. 8B show the PV diagrams of the first compression chamber 25 and the second compression chamber 26 respectively. As shown in FIG. 8A, the suction process in the first compression chamber 25 is represented by a change from Point A to Point B. The volume of the first compression chamber 25 becomes maximum at Point B. However, since the first compression chamber 25 is not provided with a check valve, a small amount of refrigerant flows back into the first suction port 19 from the first compression chamber 25 between Point B and Point C. Therefore, the actual suction volume (confined volume) of the first compression chamber 25 is identified as the volume at Point C. The compression process is represented by a change from Point C to Point D. The discharge process is represented by a change from Point D to Point E.

Figure 9:
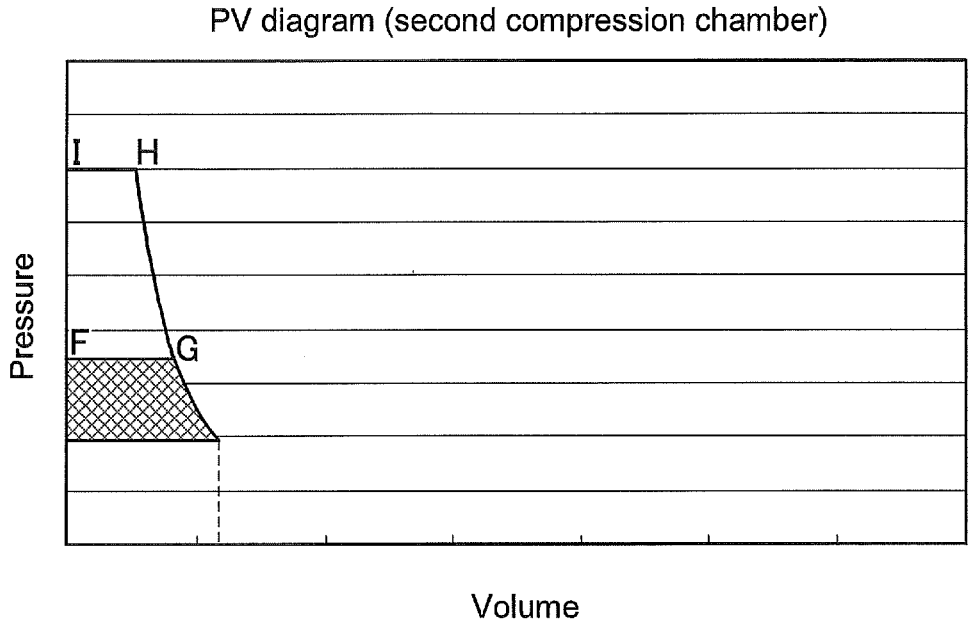
FIG. 9 is a PV diagram of the second compression chamber showing the compression work that can be reduced by injection.

As shown in FIG. 8B, the suction process in the second compression chamber 26 is represented by a change from Point F to Point G. The backflow amount of the refrigerant from the second compression chamber 26 into the second suction port 20 is nearly zero owing to the function of the suction check valve 50. Therefore, the maximum volume of the second compression chamber 26 is equal to the actual suction volume. The compression process is represented by a change from Point G to Point H. The discharge process is represented by a change from Point H to Point I. Since the second compression chamber 26 draws and compresses a gaseous refrigerant having an intermediate pressure, the compression work corresponding to the area of a shaded region can be reduced, as shown in FIG. 9. Thereby, the efficiency of the refrigeration cycle apparatus 100 is increased. It should be noted that FIG. 8B and FIG. 9 are PV diagrams obtained by assuming that the dead volume caused by the suction check valve 50 is zero.

Figure 10A:
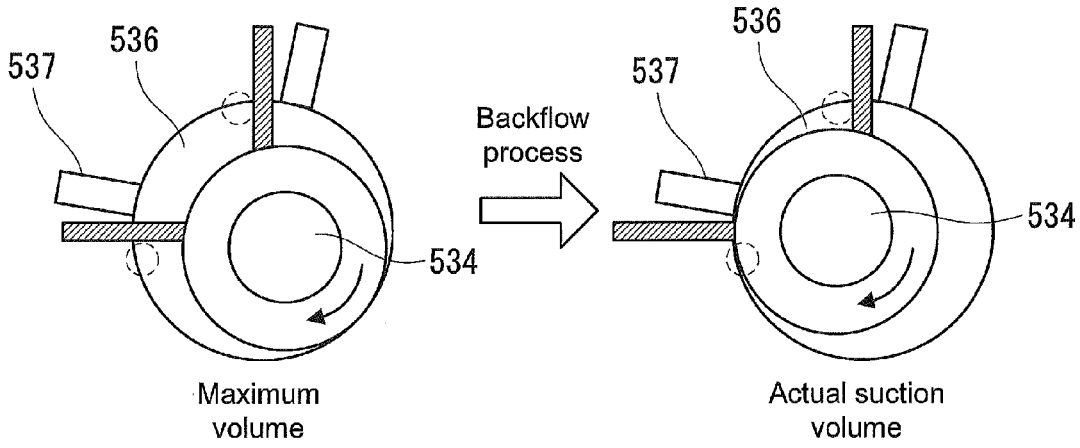
FIG. 10A is a schematic diagram showing the operation of a rotary compressor provided with no suction check valve.

For information, FIG. 10A is a schematic diagram showing the operation of a rotary compressor without a suction check valve. The angle between two vanes is 90 degrees. A compression chamber 536 and a suction port 537 correspond to the second compression chamber 26 and the second suction port 20, respectively, of the present embodiment. In the state shown in the left side of FIG. 10A, the compression chamber 536 has a maximum volume. However, during the rotation of the shaft 534 from the state shown in the left side to the state shown in the right side, a refrigerant flows from the compression chamber 536 back into the suction port 537 (backflow process).

Figure 10B:
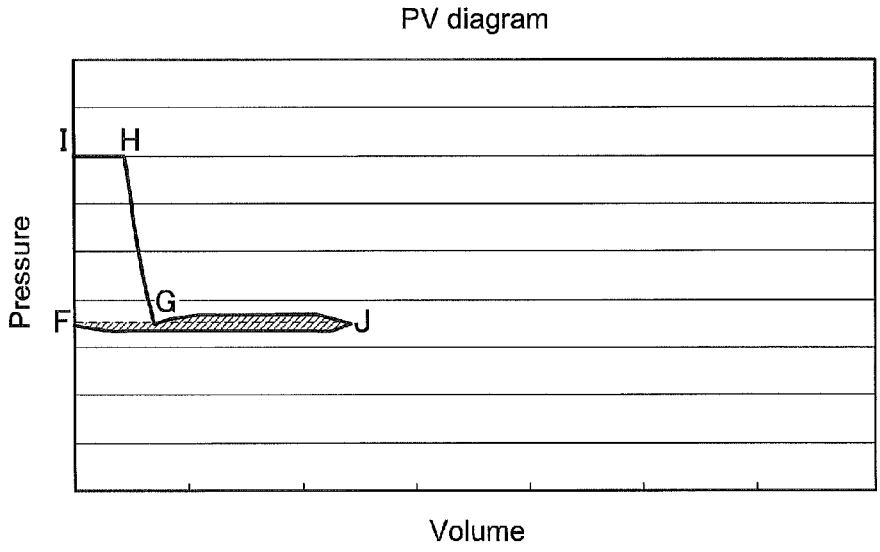
FIG. 10B is a PV diagram of a second compression chamber shown in FIG. 10A.

In fact, as shown in FIG. 10B, when the maximum volume is represented as a volume at Point J, the volume at the moment when the compression actually starts (actual suction volume) is represented as a volume at Point G. That is, a considerable percentage of the refrigerant (corresponding to a volume obtained by subtracting the volume at Point G from the volume at Point J) is pushed out of the compression chamber 536 in the backflow process. Therefore, a very large loss occurs. A shaded region in FIG. 10B represents the sum of a loss that occurs when the compression chamber 536 draws the refrigerant from Point F to Point J and a loss that occurs due to the backflow of the refrigerant when the volume of the compression chamber 536 decreases from Point J to Point G (the sum is an unnecessary compression work). Furthermore, there is a concern that the backflow of the refrigerant causes pulsation, which may increase noise and vibration. The rotary compressor 102 of the present embodiment can solve these problems.

In each of FIG. 8A, FIG. 8B, FIG. 9 and FIG. 10B, the vertical axis (pressure axis) and the horizontal axis (volume axis) are drawn on the same scale. FIG. 10A and FIG. 10B are diagrams for explaining the problems that may occur without a suction check valve, and are not the prior art of the present invention.

Next, the positional relationship between the first vane 32 and the second vane 33 is described. The positional relationship between them is also closely related to the timing of opening and closing the suction check valve 50. The open/close timing of the suction check valve 50 also depends on the type of the refrigerant, the intended use of the refrigeration cycle apparatus 100, etc.

According to the present embodiment, the angle θ between the first angular position (0 degrees) where the first vane 32 is disposed and the second angular position where the second vane 33 is disposed is set to 270 degrees or more in the rotation direction of the shaft 4. The angle θ should be set appropriately depending on the flow rate of the refrigerant to be compressed in the first compression chamber 25 and the flow rate of the refrigerant to be compressed in the second compression chamber 26.

However, the amount of the refrigerant flowing from the first compression chamber 25 back into the first suction port 19 increases as the angle θ decreases. An appropriate range of angles θ is, for example, $270 \leq \theta \leq 350$.

Figure 11:
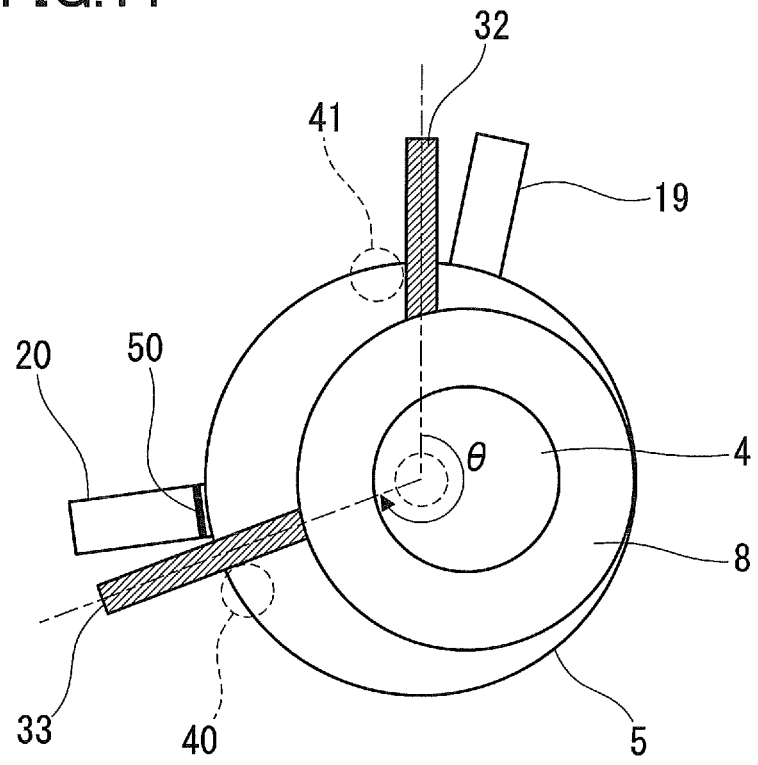
FIG. 11 is a schematic diagram showing a modification designed to have an obtuse angle between a first vane and a second vane.

Of course, the optimum angle θ varies depending on the intended use of the refrigeration cycle apparatus 100. It is conceivable to set the angle θ to less than 270 degrees, as shown in FIG. 11. The amount of the refrigerant flowing from the first compression chamber 25 back into the first suction port 19 increases as the angle θ decreases. In order to prevent the refrigerant from flowing from the first compression chamber 25 back into the first suction port 19, a suction check valve can be provided also in the first suction port 19.

The above findings indicate that the suction check valve 50 prevents the refrigerant drawn into the second compression chamber 26 from flowing back outside the second compression chamber 26 through the second suction port 20 during the period defined as (i), (ii) or (iii): (i) during a period from a point of time when the second compression chamber 26 reaches a maximum volume to a point of time when the second compression chamber 26 reaches a minimum volume (almost equal to 0); (ii) during a period from the point of time when the second compression chamber 26 reaches the maximum volume to a point of time when the compressed refrigerant begins to be discharged outside the second compression chamber 26 through the second discharge port 41; and (iii) during a period from the point of time when the second compression chamber 26 reaches the maximum volume to a point of time when the point of contact between the cylinder 5 and the piston 8 passes the second suction port 20 as the shaft 4 rotates. When the angle θ is relatively large, the suction check valve 50 prevents the backflow during the period (i). When the angle θ is relatively small, the suction check valve 50 prevents the backflow during the period (ii) or (iii).

Meanwhile, the present inventors have also ascertained that a rotary compressor having a plurality of vanes has the following problem.

Figure 21:
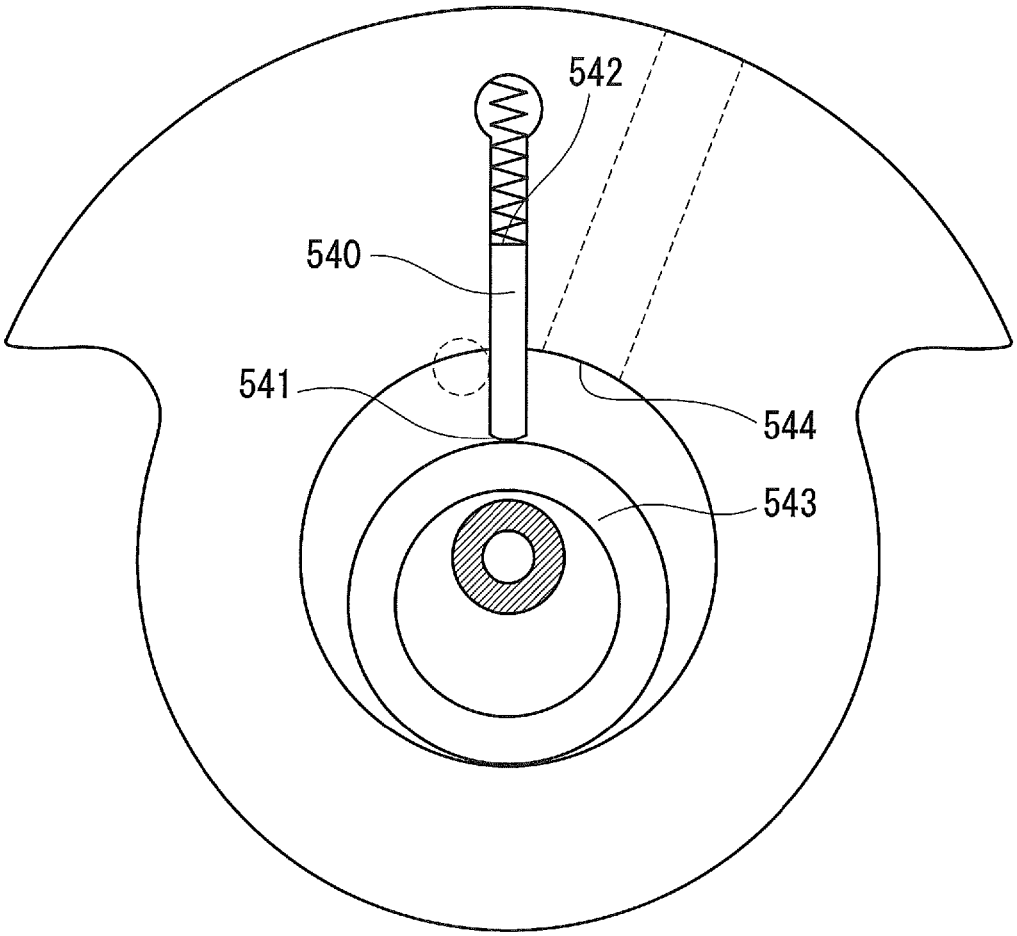
FIG. 21 is a transverse cross-sectional view of a conventional rolling piston compressor having only one vane.

As shown in FIG. 21, in a conventional rolling piston compressor having only one vane, a force to press a vane 540 against a piston 543 is generated mainly due to a difference between a pressure applied to a front surface 541 of the vane 540 and a pressure applied to a rear surface 542 thereof. If the compressor is a high-pressure shell type compressor, a pressure equal to a discharge pressure (high pressure) is applied to the rear surface 542 of the vane 540. The vane 540 has the front surface 541 having an arc shape in plan view, and is in contact with the piston 543 at the front surface 541. When only one vane 540 is provided in one cylinder, the right side of the front surface 541 with respect to the point of contact between the vane 540 and the piston 543 is always exposed to a suction pressure (low pressure) from a suction port 544. The left side of the front surface 541 is exposed to a pressure that varies between the suction pressure (low pressure) and the discharge pressure (high pressure). Even when the left side of the front surface 541 is exposed to the discharge pressure (high pressure), the right side of the front surface 541 is always exposed to the suction pressure (low pressure), and thus a sufficient pressure difference is maintained between the front surface 541 and the rear surface 542. Therefore, a force great enough to press the vane 540 against the piston 543 is always applied to the vane 540.

Figure 20:
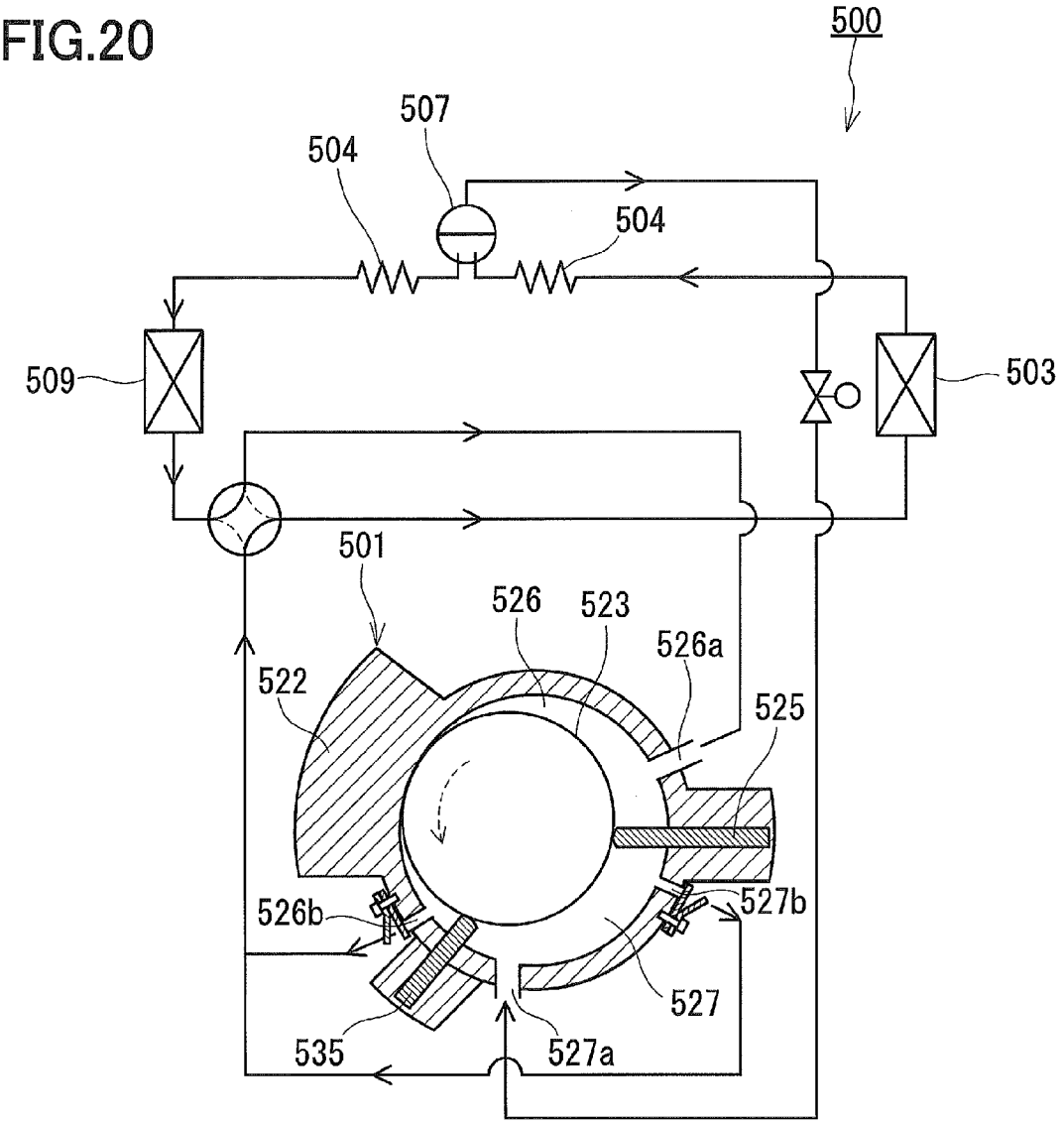
FIG. 20 is a configuration diagram of a conventional heat pump type heating apparatus.

On the other hand, in a rolling piston compressor 501 described in Patent Literature 2, two vanes are provided in one cylinder. Pressing forces applied to the two vanes are discussed based on the same logic applied to a rolling piston compressor having only one vane. As shown in FIG. 20, one side of the front surface of the vane 525 is always exposed to a suction pressure (low pressure) from the suction port 526*a*. The other side of the front surface of the vane 525 is exposed to a pressure in the auxiliary compression chamber 527. The pressure in the auxiliary compression chamber 527 varies between a pressure (intermediate pressure) of a gas phase refrigerant separated in the gas-liquid separator 507 and a discharge pressure (high pressure). Therefore, if it is assumed that the rolling piston compressor 501 is a high-pressure shell type compressor, a force great enough to press the vane 525 against the piston 523 is applied to the vane 525.

Next, one side of the front surface of the vane 535 is always exposed to a suction pressure from the suction port 527*a*, that is, the pressure (intermediate pressure) of the gas phase refrigerant separated in the gas-liquid separator 507. The other side of the front surface of the vane 535 is exposed to a pressure in the main compression chamber 526. The pressure in the main compression chamber 526 varies between the suction pressure (low pressure) and the discharge pressure (high pressure). Therefore, the pressing force applied to the vane 535 (minimum pressing force) is less than the pressing force applied to the vane 525 and that applied to the vane 540 of the conventional rolling piston compressor.

If the pressing force applied to the vane is small, a malfunction called "vane jumping" may occur. As stated herein, "vane jumping" means a phenomenon in which the tip of the vane loses contact with the piston. Vane jumping may cause a significant decrease in the compressor efficiency. Particularly in the case where the suction check valve 50 is provided in the second suction port 20 as in the present embodiment, vane jumping is likely to occur. As a means for preventing the occurrence of vane jumping, the following configurations can be proposed. The occurrence of vane jumping can be prevented by adopting at least one of the following configurations.

Figure 12A:
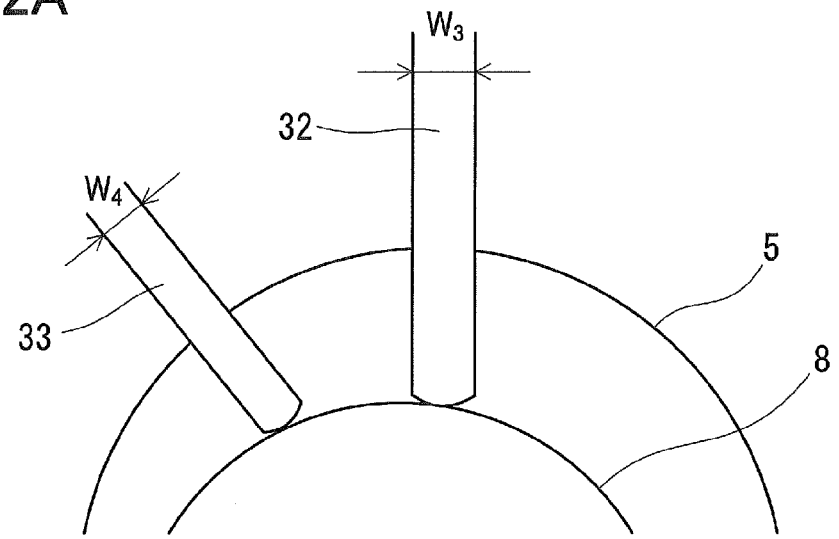
FIG. 12A is a schematic diagram of a modification of the vanes.

In a configuration shown in FIG. 12A, the width $W_4$ of the second vane 33 is smaller than the width $W_3$ of the first vane 32. Instead of or in addition to the adjustment of the width, the weight of the second vane 33 may be adjusted to be smaller than that of the first vane 32. Even if the size of the first vane 32 is equal to that of the second vane 33, the weight of the second vane can be reduced by using a lighter material for the second vane 33 than that for the first vane 32. For example, in the case where the first vane 32 is made of a metal containing iron as a main component (i.e., a component having the largest content in terms of mass percentage), the second vane 33 can be formed of a material containing aluminum as a main component. The "width of the vane" means the dimension of the vane in a direction perpendicular to the axial direction of the shaft 4 and the longitudinal direction of the vane.

Figure 12B:
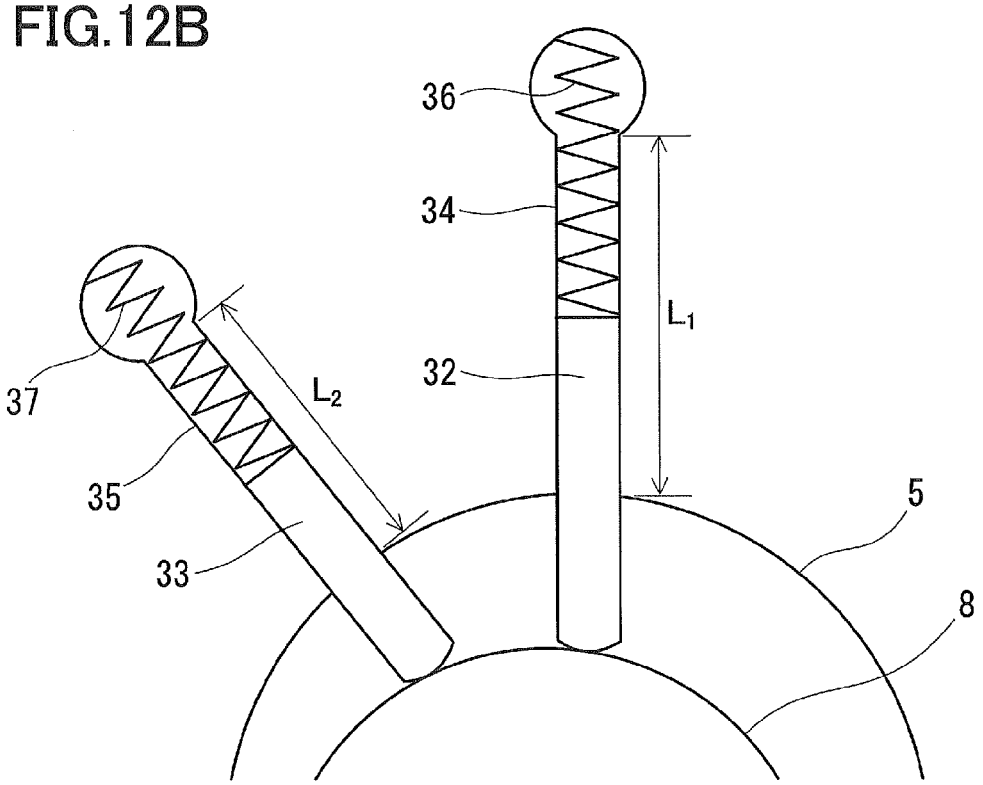
FIG. 12B is a schematic diagram of another modification of the vanes.

In a configuration shown in FIG. 12B, the seal length $L_2$ of the second vane 33 is shorter than the seal length $L_1$ of the first vane 32. In other words, the second vane 33 is shorter than the first vane 32. The "seal length" means the longitudinal length of the contact surface between the vane and the vane groove when the vane is pushed all the way into the vane groove. As the second spring 37, a spring having a larger spring constant than the first spring 36 may be used.

In each of the above configurations, the inertial force acting on the second vane 33 can be reduced. With the use of a spring having a large spring constant, the spring pressing force can be increased. Therefore, even if the pressing force generated by the difference between the pressure applied to the front surface of the vane and the pressure applied to the rear surface thereof is small, jumping of the second vane 33 can be prevented.

(Modification)

Figure 13:
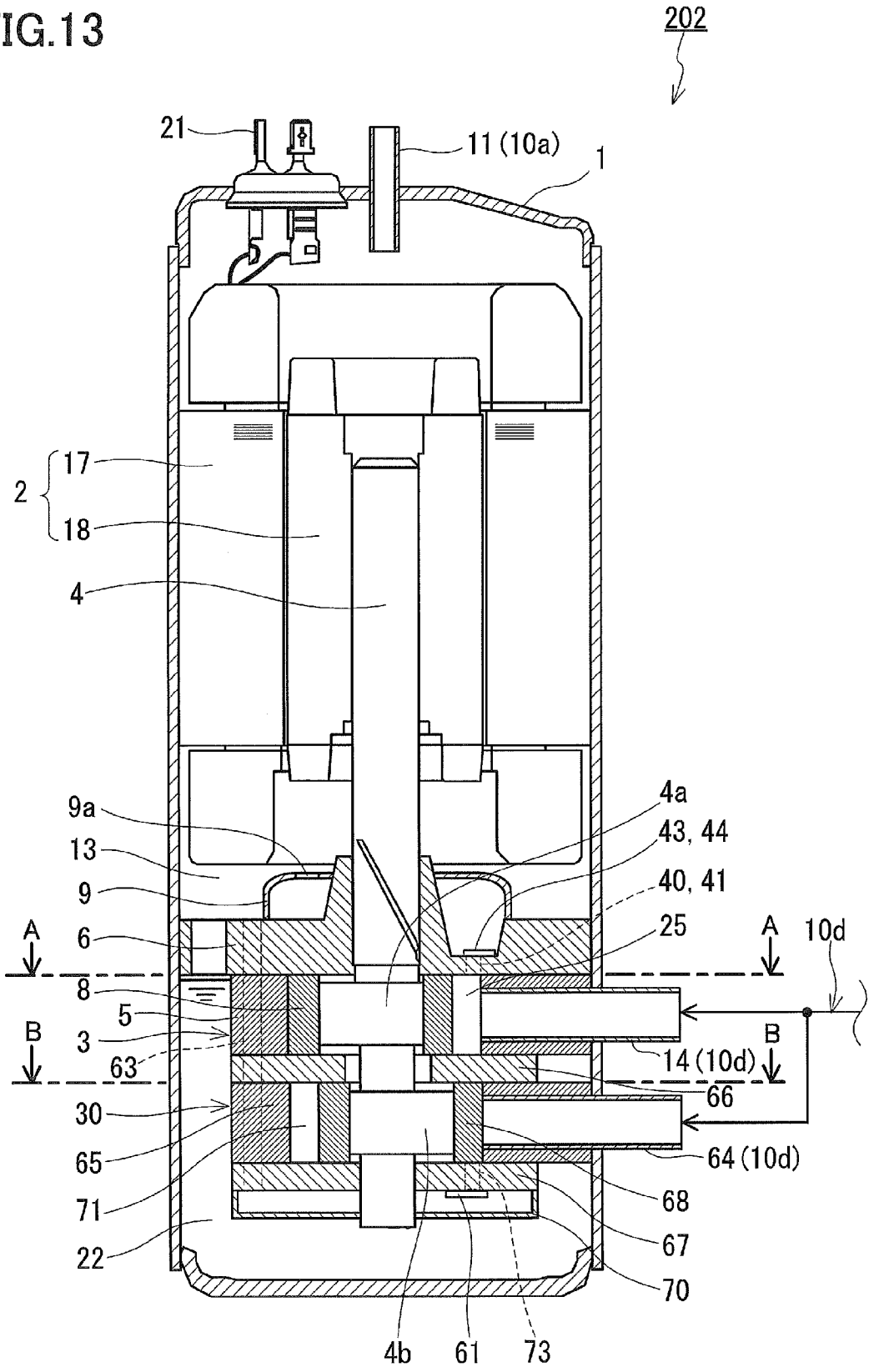
FIG. 13 is a longitudinal cross-sectional view of a rotary compressor according to a modification.

FIG. 13 is a longitudinal cross-sectional view of a rotary compressor according to a modification. A rotary compressor 202 has a structure in which components such as a cylinder is added to the rotary compressor 102 shown in FIG. 2. In the present modification, the compression mechanism 3, the cylinder 5, the piston 8 and the eccentric portion 4*a* shown in FIG. 2 are defined as a first compression mechanism 3, a first cylinder 5, a first piston 8, and a first eccentric portion 4*a*, respectively. The detailed structure of the first compression mechanism 3 is as described with reference to FIG. 2 to FIG. 6.

Figure 14:
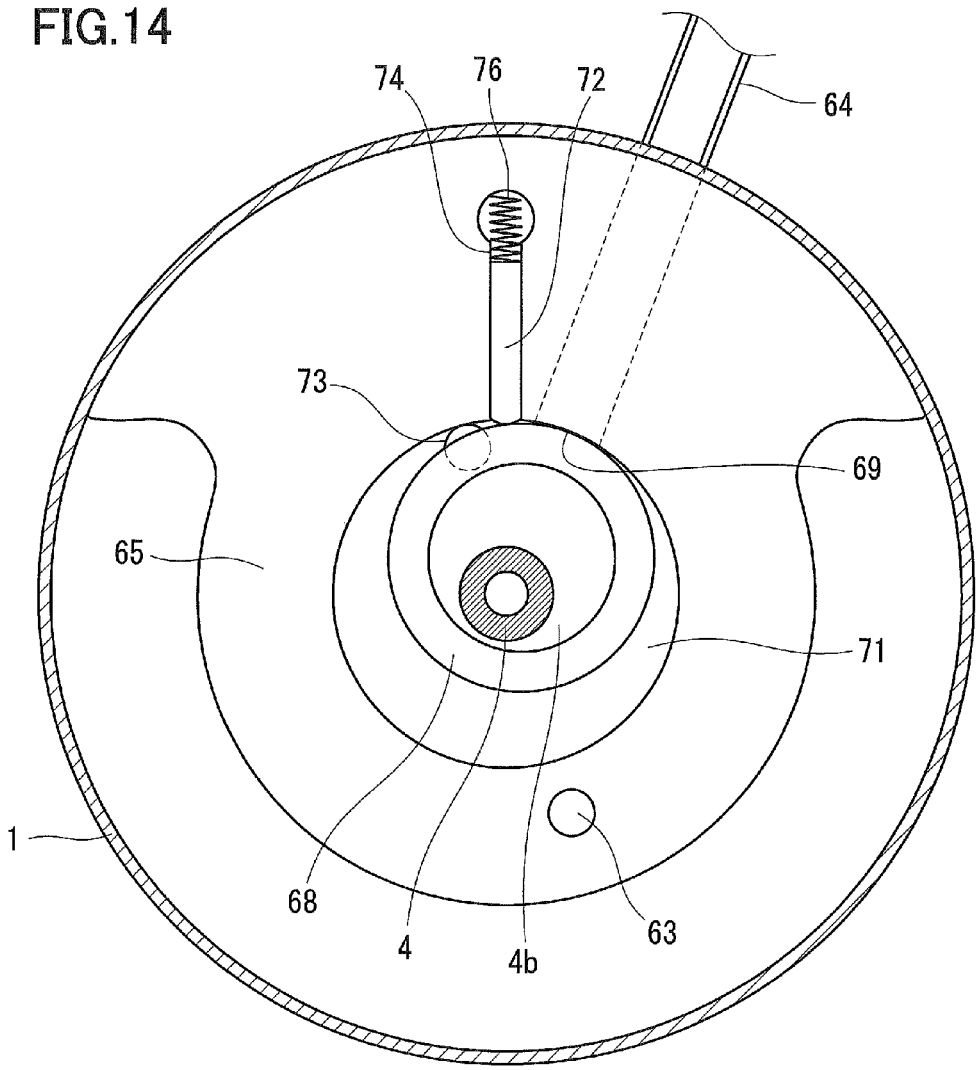
FIG. 14 is a transverse cross-sectional view of the rotary compressor shown in FIG. 13, taken along the line B-B.

As shown in FIG. 13 and FIG. 14, the rotary compressor 202 includes a second compression mechanism 30 in addition to the first compression mechanism 3. The second compression mechanism 30 has a second cylinder 65, an intermediate plate 66, a second piston 68, an auxiliary bearing 67, a muffler 70, a third vane 72, a third suction port 69, and a third discharge port 73. The second cylinder 65 is disposed concentrically with the first cylinder 5, and separated from the first cylinder 5 by the intermediate plate 66.

The shaft 4 has a second eccentric portion 4*b* projecting outwardly in a radial direction. The second piston 68 is disposed within the second cylinder 65. Within the second cylinder 65, the second piston 68 is fitted to the second eccentric portion 4*b* of the shaft 4. The intermediate plate 66 is disposed between the first cylinder 5 and the second cylinder 65. A vane groove 74 is formed in the second cylinder 65. A third vane 72 (blade) having a tip in contact with the outer peripheral surface of the second piston 68 is slidably fitted in the vane groove 74. The third vane 72 divides the space between the second cylinder 65 and the second piston 68 along the circumferential direction of the second piston 68. Thereby, a third compression chamber 71 is formed within the second cylinder 65. The second piston 68 and the third vane 72 may be constituted by a single component, i.e., a so-called swing piston. The third vane 72 may be coupled to the second piston 68. A third spring 76 pressing the third vane 72 toward the center of the shaft 4 is disposed behind the third vane 72.

A third suction port 69 introduces the refrigerant to be compressed in the third compression chamber 71 into the third compression chamber 71. A third suction pipe 64 is connected to the third suction port 69. The third discharge port 73 penetrates the auxiliary bearing 67 and opens into the internal space of the muffler 70. The refrigerant compressed in the third compression chamber 71 is discharged outside the third compression chamber 71, specifically, to the internal space of the muffler 70, from the third compression chamber 71 through the third discharge port 73. The refrigerant is introduced from the internal space of the muffler 70 into the internal space 13 of the closed casing 1 through the flow path 63 passing through the main bearing 6, the first cylinder 5, the intermediate plate 66, the second cylinder 65 and the auxiliary bearing 67 in the axial direction of the shaft 4. The flow path 63 may open into the internal space 13 of the closed casing 1, or into the internal space of the muffler 9.

As described above, the second compression mechanism 30 has the same structure as a compression mechanism of a typical rolling piston compressor having only one vane.

In the rotary compressor 202, the height, inner diameter and outer diameter of the second cylinder 65 are equal to the height, inner diameter and outer diameter of the first cylinder 5, respectively. The outer diameter of the first piston 8 is equal to that of the second piston 68. Since only the third compression chamber 71 is formed within the second cylinder 65, the first compression chamber 25 has a smaller volume than the third compression chamber 71. This means that the shared use of the components between the first compression mechanism 3 and the second compression mechanism 30 can lead to a cost reduction and increased ease of assembling.

In the present modification, the first compression mechanism 3 and the second compression mechanism 30 are disposed on the upper side and the lower side of the axial direction of the shaft 4, respectively. The refrigerant compressed in the first compression mechanism 3 is introduced into the internal space of the muffler 9 through the discharge ports 40 and 41 provided in the main bearing 6. The first compression mechanism 3 has two discharge ports 40 and 41. Therefore, it is desirable to reduce the distance between the discharge ports 40 and 41 and the internal space 13 of the closed casing 1 as much as possible so as to reduce the pressure loss of the refrigerant in the discharge ports 40 and 41 as much as possible. From this viewpoint, it is preferable to dispose the first compression mechanism 3 on the upper side of the axial direction.

However, from another viewpoint, the first compression mechanism 3 may be disposed on the lower side of the axial direction. The reason for this is as follows. The nearer the motor 2 is, the higher the temperature in the closed casing 1 is. This means that the main bearing 6 has a higher temperature than the auxiliary bearing 67 and the muffler 70 during the operation of the rotary compressor 202. Therefore, when the first compression mechanism 3 is disposed on the upper side and the second compression mechanism 30 is disposed on the lower side, the refrigerant to be introduced into the second compression chamber 26 is likely to be heated. Then, the mass flow rate of the refrigerant to be compressed in the second compression chamber 26 decreases, which also reduces the injection effect. In order to obtain a higher injection effect, the second compression mechanism 30 may be disposed on the upper side and the first compression mechanism 3 having the second compression chamber 26 may be disposed on the lower side.

As shown in FIG. 13, the angular difference between the direction in which the first eccentric portion 4*a* projects and the direction in which the second eccentric portion 4*b* projects is 180 degrees in the rotation direction of the shaft 4. In other words, the phase difference between the first piston 8 and the second piston 68 is 180 degrees in the rotation direction of the shaft 4. In still other words, the timing of the top dead center of the first piston 8 is shifted from the timing of the top dead center of the second piston 68 by 180 degrees. With such a configuration, the vibration generated by the rotation of the first piston 8 can be cancelled by the rotation of the second piston 68. Furthermore, the compression process in the first compression chamber 25 and the compression process in the third compression chamber 71 are performed almost alternately, and the discharge process in the first compression chamber 25 and the discharge process in the third compression chamber 71 are performed almost alternately. Therefore, the torque variation of the shaft 4 can be reduced, which is advantageous in reducing the motor loss and mechanical loss. The vibration and noise of the rotary compressor 202 also can be reduced. The "timing of the top dead center of the piston" means the timing when the vane is pushed all the way into the vane groove by the piston.

When the rotary compressor 202 is used in the refrigeration cycle apparatus 100 shown in FIG. 1, the following configuration can be adopted. The refrigeration cycle apparatus 100 has the suction flow path 10*d* for introducing the refrigerant that has flowed out of the first heat exchanger 104 or the second heat exchanger 112 as an evaporator into the first suction port 19 of the rotary compressor 202. As shown in FIG. 13, the suction flow path 10*d* includes a branch portion 14 extending toward the first suction port 19 and a branch portion 64 extending toward the third suction port 69 so that the refrigerant that has flowed out of the first heat exchanger 104 or the second heat exchanger 112 is introduced into both the first suction port 19 and the third suction port 69 of the rotary compressor 202. In the present embodiment, the first suction pipe 14 constitutes the branch portion 14 and the third suction pipe 64 constitutes the branch portion 64. With such a configuration, the refrigerant can be introduced smoothly into the first compression chamber 25 and the third compression chamber 71. The suction flow path 10*d* may branch in the closed casing 1.

Second Embodiment

Figure 15:
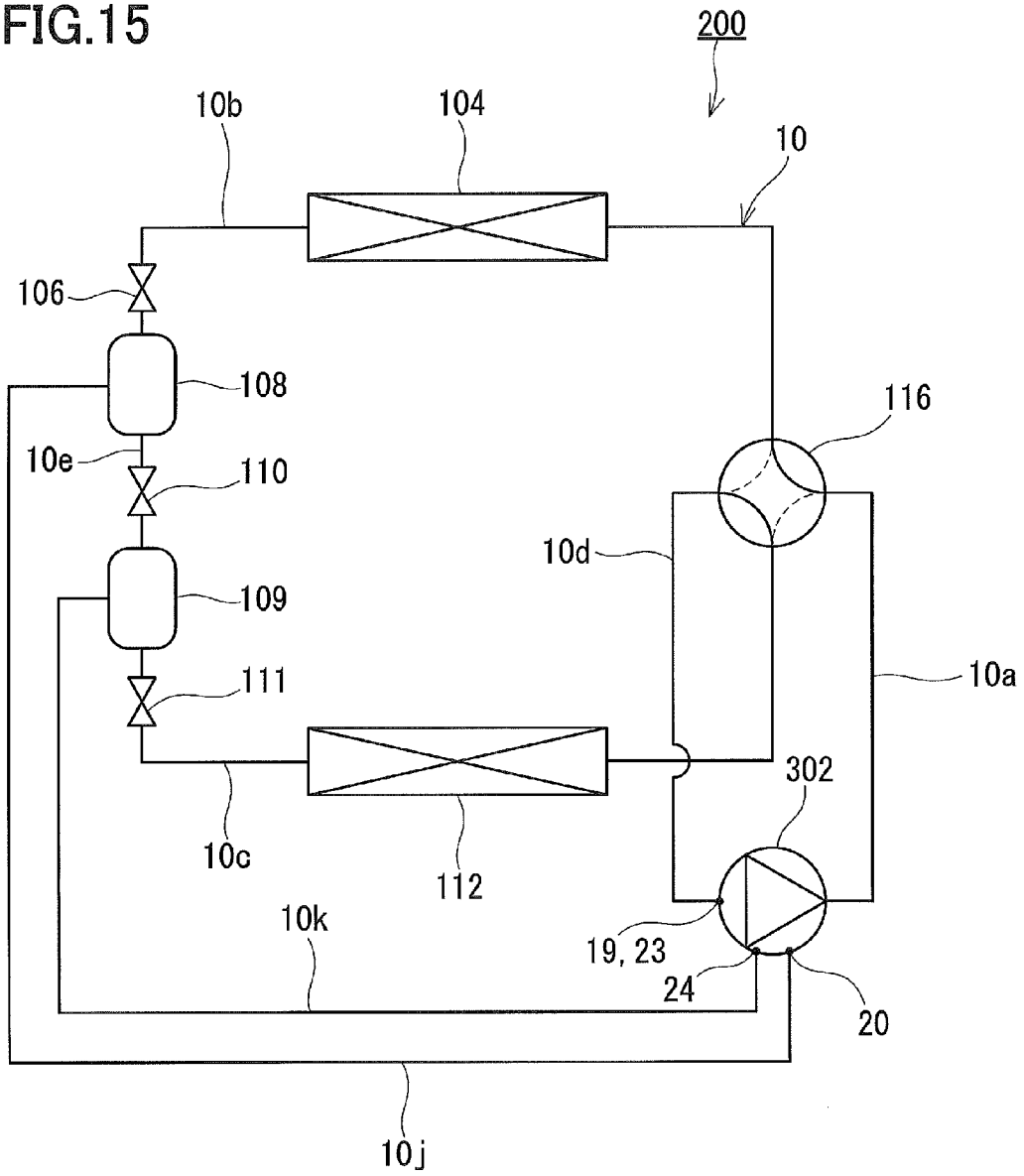
FIG. 15 is a configuration diagram of a refrigeration cycle apparatus according to a second embodiment of the present invention.

FIG. 15 is a configuration diagram of a refrigeration cycle apparatus according to a second embodiment. A refrigeration cycle apparatus 200 of the present embodiment is different from the refrigeration cycle apparatus 100 of the first embodiment in that injection is performed in two steps. Since the injection is performed in two steps, the refrigeration cycle apparatus 200 is highly effective particularly when it is used for heating or hot water supply. Hereinafter, the components that have been described in the first embodiment are denoted by the same reference numerals, and no further description thereof is given.

The refrigeration cycle apparatus 200 includes a rotary compressor 302, a first heat exchanger 104, a first expansion mechanism 106, a first gas-liquid separator 108, a second expansion mechanism 110, a second gas-liquid separator 109, a third expansion mechanism 111, and a second heat exchanger 112. These components are connected in a loop in this order by flow paths 10*a* to 10*e* so as to form a refrigerant circuit 10. A four-way valve 116, as a switching mechanism capable of switching the flow direction of a refrigerant, is provided in the refrigerant circuit 10.

The first expansion mechanism 106 expands the refrigerant cooled in the first heat exchanger 104 as a radiator. The first gas-liquid separator 108 separates the refrigerant expanded in the first expansion mechanism 106 into a gas phase refrigerant and a liquid phase refrigerant. The second expansion mechanism 110 expands the liquid phase refrigerant separated in the first gas-liquid separator 108. The second gas-liquid separator 109 separates the refrigerant expanded in the second expansion mechanism 110 into a gas phase refrigerant and a liquid phase refrigerant. The third expansion mechanism 111 expands the liquid phase refrigerant separated in the second gas-liquid separator 109. After passing through the third expansion mechanism 111, the refrigerant flows into the second heat exchanger 112 as an evaporator. The function of the four-say valve 116 allows the refrigerant to flow also in the direction opposite to the above direction.

The rotary compressor 302 has a first suction port 19, a second suction port 20, a third suction port 23, and a fourth suction port 24. The suction flow path 10*d* introduces the refrigerant that has flowed out of the first heat exchanger 104 or the second heat exchanger 112 into each of the first suction port 19 and the third suction port 23 of the rotary compressor 302.

The refrigeration cycle apparatus 200 further includes a first injection flow path 10*j* and a second injection flow path 10*k*. The first injection flow path 10*j* has one end connected to the first gas-liquid separator 108 and the other end connected to the rotary compressor 302, and introduces the gas refrigerant separated in the first gas-liquid separator 108 to the rotary compressor 302. The second injection flow path 10*k* has one end connected to the second gas-liquid separator 109 and the other end connected to the rotary compressor 302, and introduces the gas refrigerant separated in the second gas-liquid separator 109 to the rotary compressor 302.

The refrigeration cycle apparatus 200 of the present embodiment is different from the refrigerant cycle apparatus 100 of the first embodiment in that the former has the second gas-liquid separator 109 and the second injection flow path 10*k* in addition to the first gas-liquid separator 108 and the first injection flow path 10*j*. Furthermore, the rotary compressor 302 used in the refrigeration cycle apparatus 200 of the second embodiment is configured to perform injection in two steps.

Figure 16:
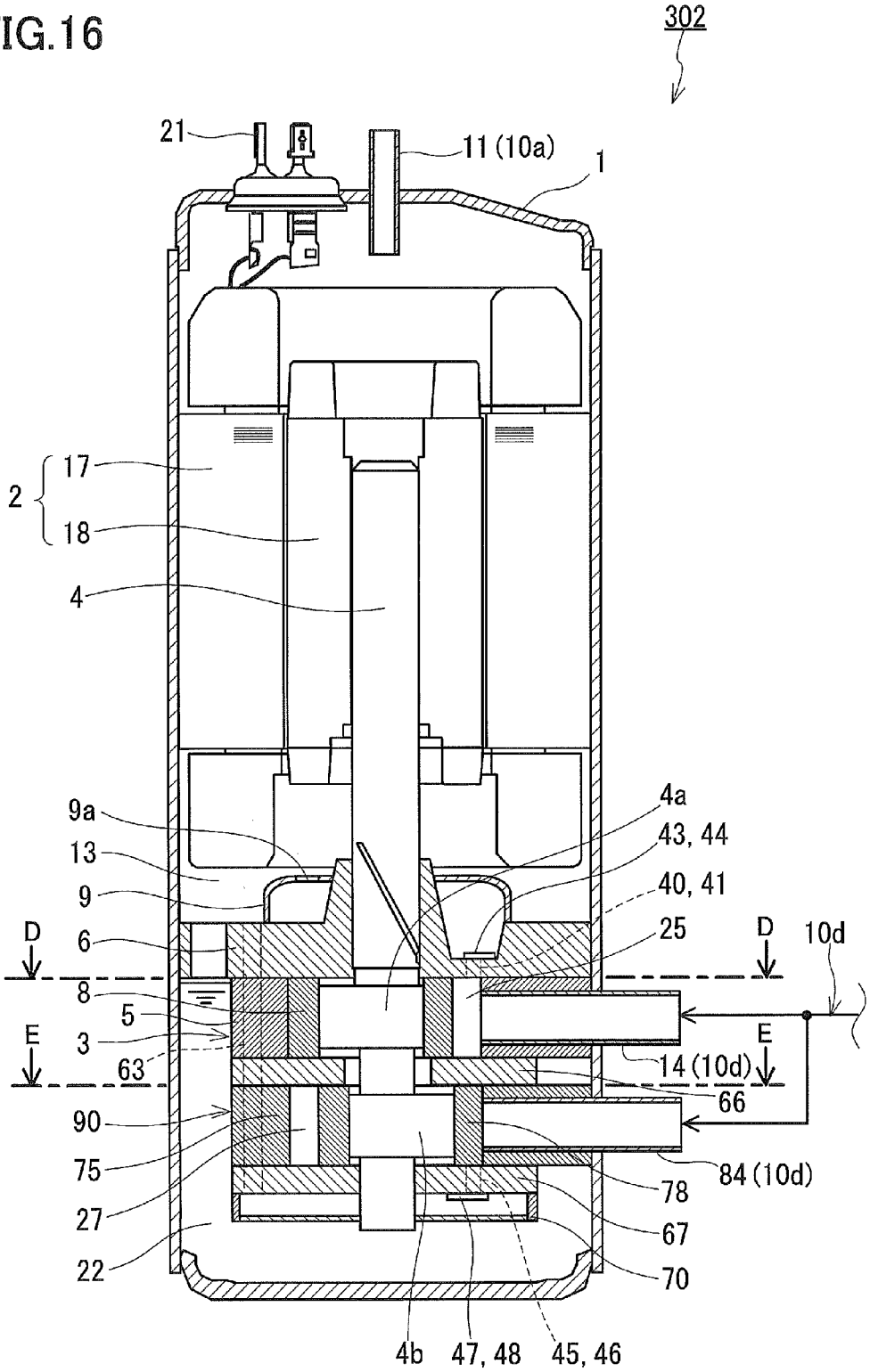
FIG. 16 is a longitudinal cross-sectional view of a rotary compressor used in the refrigeration cycle apparatus shown in FIG. 15.
Figure 17A:
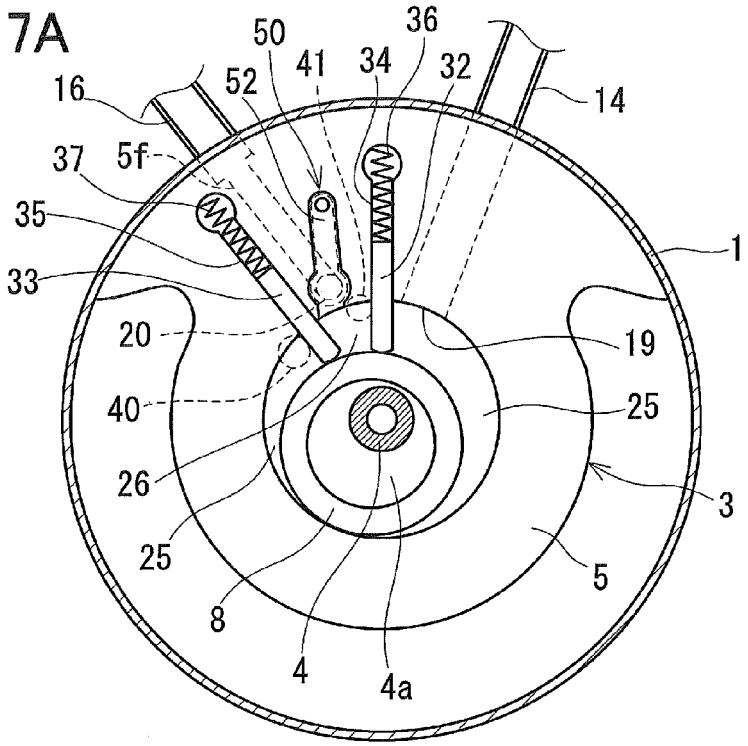
FIG. 17A is a transverse cross-sectional view of the rotary compressor shown in FIG. 16, taken along the line D-D.
Figure 17B:
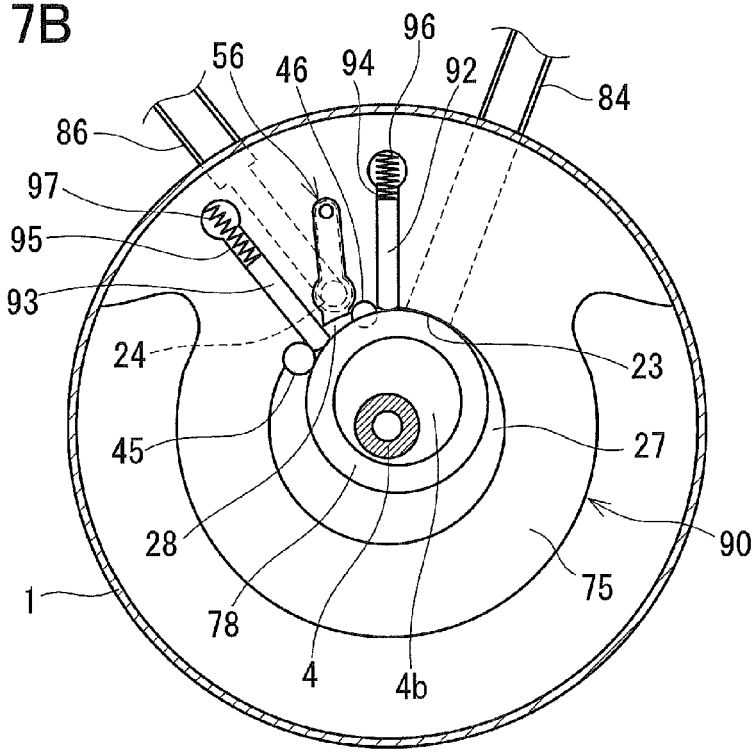
FIG. 17B is a transverse cross-sectional view of the rotary compressor shown in FIG. 16, taken along the line E-E.

As shown in FIG. 16, FIG. 17A, and FIG. 17B, the rotary compressor 302 includes the compression mechanism 3 described in the first embodiment and a second compression mechanism 90 having the same structure as the compression mechanism 3. The second compression mechanism 90 is disposed concentrically with the first compression mechanism 3 so that they share the shaft 4. The compression mechanism 3, the cylinder 5, the piston 8, the eccentric portion 4*a*, and the suction check valve 50 of the rotary compressor 102 described in the first embodiment are defined as a first compression mechanism 3, a first cylinder 5, a first piston 8, a first eccentric portion 4*a*, and a first suction check valve 50, respectively.

As shown in FIG. 16 and FIG. 17B, the second compression mechanism 90 has a second cylinder 75, a second piston 78, a third vane 92, a fourth vane 93, a third suction port 23, a third discharge port 45, a third discharge valve 47, a fourth suction port 24, a fourth discharge port 46, a fourth discharge valve 48, and a second suction check valve 56. The second cylinder 75 is disposed concentrically with the first cylinder 5. The second piston 78 is disposed within the second cylinder 75 so as to form a second space between the second piston itself and the second cylinder 75. The shaft 4 has a second eccentric portion 4*b*, and the second piston 78 is fitted to the second eccentric portion 4*b*. The third vane 92 is attached to the second cylinder 75 at a third angular position along the rotation direction of the shaft 4, and divides the second space along the circumferential direction of the second piston 78. The fourth vane 93 is attached to the second cylinder 75 at a fourth angular position along the rotation direction of the shaft 4, and further divides the second space divided by the third vane 92 so that a third compression chamber 27 and a fourth compression chamber 28 having a smaller volume than the third compression chamber 27 are formed within the second cylinder 75. The third suction port 23 introduces a working fluid to be compressed in the third compression chamber 27 into the third compression chamber 27. The third discharge port 45 discharges the working fluid compressed in the third compression chamber 27 outside the third compression chamber 27 from the third compression chamber 27. The fourth suction port 24 introduces the working fluid to be compressed in the fourth compression chamber 28 into the fourth compression chamber 28. The fourth discharge port 46 discharges the working fluid compressed in the fourth compression chamber 28 outside the fourth compression chamber 28 from the fourth compression chamber 28. The second suction check valve 56 is provided in the fourth suction port 24. As described above, the second compression mechanism 90 has essentially the same structure as the first compression mechanism 3.

That is, the first cylinder 5, the first piston 8, the first vane 32, the second vane 33, the first suction port 19, the first discharge port 40, the first discharge valve 43, the second suction port 20, the second discharge port 41, the second discharge valve 44, and the first suction check valve 50 of the first compression mechanism 3 correspond to the second cylinder 75, the second piston 78, the third vane 92, the fourth vane 93, the third suction port 23, the third discharge port 45, the third discharge valve 47, the fourth suction port 24, the fourth discharge port 46, the fourth discharge valve 48, and the second suction check valve 57 of the second compression mechanism 90, respectively. The first vane groove 34, the first spring 36, the second vane groove 35, and the second spring 37 of the first compression mechanism 3 correspond to the third vane groove 94, the third spring 96, the fourth vane groove 95, and the fourth spring 97 of the second compression mechanism 90, respectively. Furthermore, the first compression chamber 25 and the second compression chamber 26 of the first compression mechanism 3 correspond to the third compression chamber 27 and the fourth compression chamber 28 of the second compression mechanism 90, respectively. The first angular position and the second angular position correspond to the third angular position and the fourth angular position, respectively. Furthermore, the first suction pipe 14 and the second suction pipe 16 of the rotary compressor 102 correspond to the third suction pipe 84 and the fourth suction pipe 86 of the rotary compressor 302, respectively. All the structures and descriptions of the first compression mechanism 3 can be applied to those of the second compression mechanism 90 correspondingly.

In the rotary compressor 302, the angular difference between a direction in which the first eccentric portion 4*a* projects and a direction in which the second eccentric portion 4*b* projects is 180 degrees in the rotation direction of the shaft 4. In other words, the phase difference between the first piston 8 and the second piston 78 is 180 degrees in the rotation direction of the shaft 4. The effects obtained in this configuration are the same as those described for the rotary compressor 202 shown in FIG. 13.

The first injection flow path 10*j* introduces the gas phase refrigerant separated in the first gas-liquid separator 108 into the second suction port 20 of the rotary compressor 302. The second injection flow path 10*k* introduces the gas phase refrigerant separated in the second gas-liquid separator 109 into the fourth suction port 24 of the rotary compressor 302. Since both the first compression mechanism 3 and the second compression mechanism 90 can compress the refrigerant having an intermediate pressure, a further increase in the efficiency of the rotary compressor 302 can be expected.

(Modification)

Figure 18:
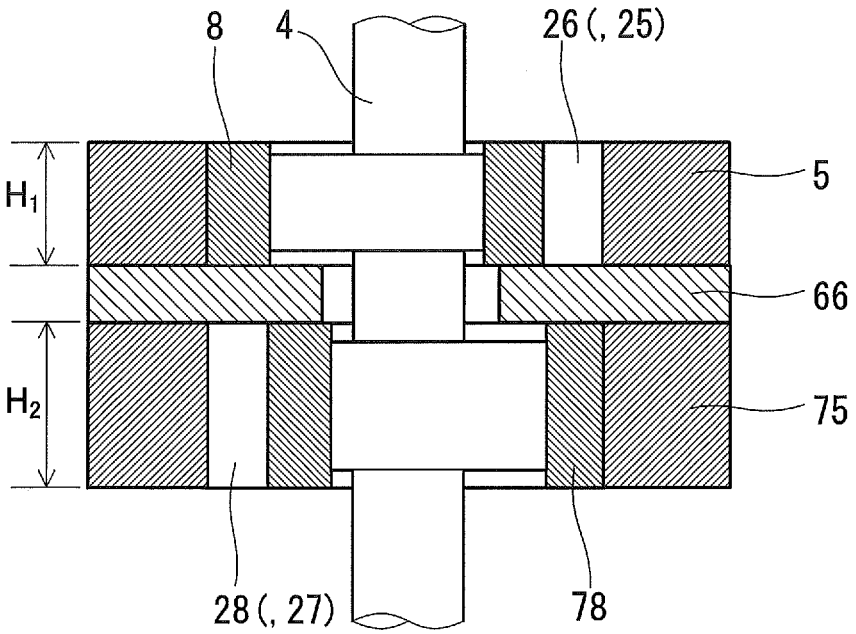
FIG. 18 is a schematic diagram showing the relationship between the thickness of a first cylinder and that of a second cylinder.

The first compression chamber 25 may have a volume different from that of the third compression chamber 27. The second compression chamber 26 may have a volume different from that of the fourth compression chamber 28. For example, in the modification shown in FIG. 18, the thickness $H_2$ of the second cylinder 75 is greater than the thickness $H_1$ of the first cylinder 5. Therefore, the fourth compression chamber 28 (second injection compression chamber) has a larger volume than the second compression chamber 26 (first injection compression chamber). In this case, the refrigerant can be supplied to the second compression chamber 26 from a high pressure side injection flow path (for example, the first injection flow path 10*j*), while the refrigerant can be supplied to the fourth compression chamber 28 from a low pressure side injection flow path (for example, the second injection flow path 10*k*). This means that a relatively low pressure refrigerant is compressed in the fourth compression chamber 28 having a relatively large volume, while a relatively high pressure refrigerant is compressed in the second compression chamber 26 having a relatively small volume. This allows the second compression chamber 26 and the fourth compression chamber 28 to draw just enough gaseous refrigerant generated in the first gas-liquid separator 108 and the second gas-liquid separator 109, respectively. The injection of just enough gaseous refrigerant into the rotary compressor 302 enables highly efficient operation of the refrigeration cycle apparatus 200.

The ratio of the volume of the fourth compression chamber 28 to the volume of the second compression chamber 26 cannot be definitely determined because it depends on the type of the refrigerant, the intended use of the refrigeration cycle apparatus 100, etc. As an example, the compression mechanisms 3 and 90 can be designed to satisfy $1.1 \leq (V_2/V_1) \leq 30$, where $V_1$ is the volume of the second compression chamber 26, and $V_2$ is the volume of the fourth compression chamber 28. The volume of the compression chamber can be adjusted by changing various design values such as the height of the cylinder, the inner diameter of the cylinder, the outer diameter of the piston, and the amount of projection of the eccentric portion of the shaft. The volume of the compression chamber can also be adjusted by changing the positional relationship between the two vanes, of course. When the volume of the second compression chamber 26 and the volume of the fourth compression chamber 28 are adjusted to satisfy the above relationship by allowing at least one design value selected from the height of the cylinder, the inner diameter of the cylinder, the outer diameter of the piston, and the amount of projection of the eccentric portion of the shaft to differ between the first compression mechanism 3 and the second compression mechanism 90, the volumes of the compression chambers can be optimized without changing the positions of the vanes.

Figure 19:
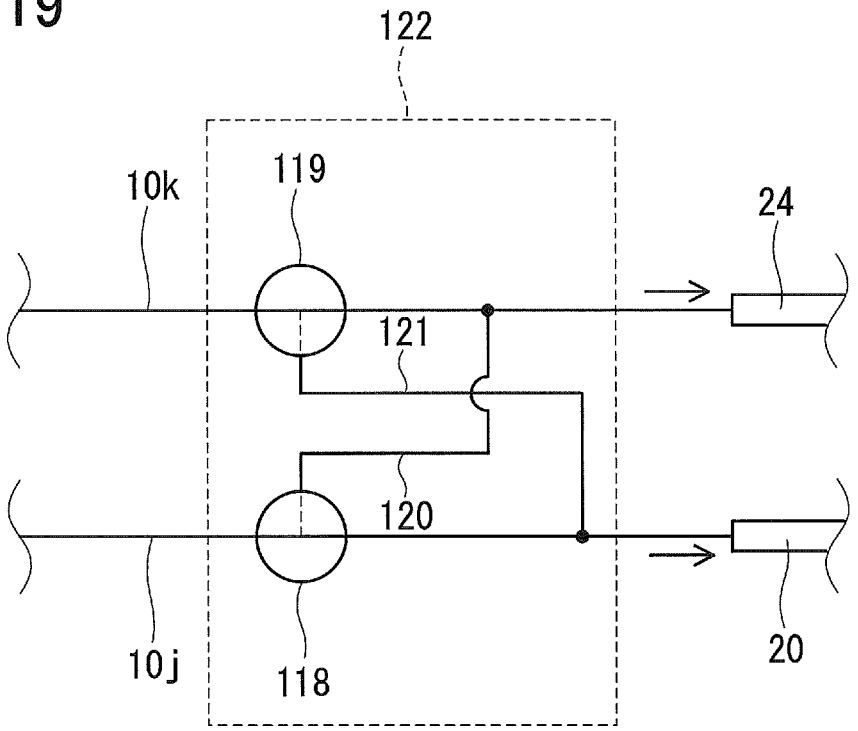
FIG. 19 is a partial configuration diagram showing modified first and second injection paths.

In the refrigeration cycle apparatus 200 shown in FIG. 15, the flow direction of the refrigerant is switched by controlling the four-way valve 116. Therefore, as shown in FIG. 19, a flow path switching portion 122 can be provided so as to introduce the refrigerant in the first injection flow path 10*j* into one selected from the second suction port 20 and the fourth suction port 24 of the rotary compressor 302 and to introduce the refrigerant in the second injection flow path 10*k* into the other of the second suction port 20 and the fourth suction port 24 of the rotary compressor 302.

The flow path switching portion 122 has a first three-way valve 118, a second three-way valve 119, a first bypass flow path 120, and a second bypass flow path 121. The first three-way valve 118 is provided in the first injection flow path 10*j*. The second three-way valve 119 is provided in the second injection flow path 10*k*. The first bypass flow path 120 connects one outlet of the first three-way valve 118 and the second injection flow path 10*k*. The second bypass flow path 121 connects one outlet of the second three-way valve 119 and the first injection flow path 10*j*. When the three-way valves 118 and 119 are controlled as indicated by solid lines, the refrigerant in the first injection flow path 10*j* is introduced into the second suction port 20 and the refrigerant in the second injection flow path 10*k* is introduced into the fourth suction port 24. When the three-way valves 118 and 119 are controlled as indicated by dashed lines, the refrigerant in the first injection flow path 10*j* is introduced into the fourth suction port 24 and the refrigerant in the second injection flow path 10*k* is introduced into the second suction port 20. This control allows appropriate pressure refrigerants to be supplied to the second compression chamber 26 and the fourth compression chamber 28 respectively, even if the flow directions of the refrigerants are changed.

INDUSTRIAL APPLICABILITY

The refrigeration cycle apparatus of the present invention can be used for water heaters, hot water heating apparatuses, air conditioners, etc.

The invention claimed is:

1. A rotary compressor comprising:

a cylinder;

a piston disposed within the cylinder so as to form a space between the piston itself and the cylinder;

a shaft to which the piston is fitted;

a first vane for dividing the space along a circumferential direction of the piston, the first vane being attached to the cylinder at a first angular position along a rotation direction of the shaft;

a second vane for further dividing the space divided by the first vane along the circumferential direction of the piston so that a first compression chamber and a second compression chamber having a smaller volume than the first compression chamber are formed within the cylinder, the second vane being attached to the cylinder at a second angular position along the rotation direction of the shaft;

a first suction port for introducing a working fluid to be compressed in the first compression chamber into the first compression chamber;

a first discharge port for discharging the working fluid compressed in the first compression chamber outside the first compression chamber from the first compression chamber;

a second suction port for introducing the working fluid to be compressed in the second compression chamber into the second compression chamber;

a second discharge port for discharging the working fluid compressed in the second compression chamber outside the second compression chamber from the second compression chamber; and a suction check valve provided in the second suction port, wherein an angle θ between the first angular position and the second angular position is set to 270 degrees or more in the rotation direction of the shaft, so that the first compression chamber occupies an interior space of the cylinder from the first vane to the second vane in the rotation direction of the shaft, and no suction check valve is provided in the first suction port.

2. The rotary compressor according to claim 1, wherein the suction check valve prevents the working fluid drawn into the second compression chamber from flowing back outside the second compression chamber through the second suction port (i) during a period from a point of time when the second compression chamber reaches a maximum volume to a point of time when the second compression chamber reaches a minimum volume, (ii) during a period from the point of time when the second compression chamber reaches the maximum volume to a point of time when the compressed working fluid begins to be discharged outside the second compression chamber through the second discharge port, or (iii) during a period from the point of time when the second compression chamber reaches the maximum volume to a point of time when a point of contact between the cylinder and the piston passes the second suction port as the shaft rotates.

3. The rotary compressor according to claim 1, wherein the second suction port has a smaller opening area than the first suction port.

4. The rotary compressor according to claim 1, wherein the second discharge port has a smaller opening area than the first discharge port.

5. The rotary compressor according to claim 1, further comprising:

a closed casing accommodating a compression mechanism, the compression mechanism including the cylinder, the piston, the first vane, and the second vane;

a discharge pipe opening into an internal space of the closed casing;

a discharge flow path connecting the internal space of the closed casing to each of the first discharge port and the second discharge port so that the working fluid discharged outside the first compression chamber through the first discharge port and the working fluid discharged outside the second compression chamber through the second discharge port flow into the discharge pipe through the internal space of the closed casing; and a motor disposed in the closed casing to be located in a flow path of the working fluid from the discharge flow path to the discharge pipe.

6. The rotary compressor according to claim 1, wherein the suction check valve includes a thin plate-like valve body having a back surface for closing the second suction port and a front surface to be exposed to an atmosphere in the second compression chamber when the second suction port is closed.

7. The rotary compressor according to claim 1, wherein the second suction port is provided so as to open into a groove communicating with the second compression chamber, and the suction check valve has: (i) a thin plate-like valve body having a back surface for closing the second suction port and a front surface to be exposed to an atmosphere in the second compression chamber when the second suction port is closed, the valve body being disposed in the groove so as to open and close the second suction port; and (ii) a valve stopper having a supporting surface for limiting an amount of displacement of the valve body in a thickness direction thereof when the second suction port is opened, the valve stopper being disposed in the groove so that the supporting surface is exposed to the atmosphere in the second compression chamber when the valve body closes the second suction port.

8. The rotary compressor according to claim 1, wherein when the cylinder is defined as a first cylinder and the piston is defined as a first piston, the rotary compressor further comprises:

a second cylinder disposed concentrically with the first cylinder;

a second piston disposed within the second cylinder and fitted to the shaft;

a third vane for dividing a space between the second cylinder and the second piston along a circumferential direction of the second piston so that a third compression chamber is formed within the second cylinder;

a third suction port for introducing the working fluid to be compressed in the third compression chamber into the third compression chamber; and a third discharge port for discharging the working fluid compressed in the third compression chamber outside the third compression chamber from the third compression chamber.

9. The rotary compressor according to claim 8, wherein the first compression chamber has a smaller volume than the third compression chamber.

10. The rotary compressor according to claim 1, wherein when the cylinder is defined as a first cylinder and the piston is defined as a first piston, the rotary compressor further comprises:

a second cylinder disposed concentrically with the first cylinder;

a second piston disposed within the second cylinder so as to form a second space between the second piston itself and the second cylinder and fitted to the shaft;

a third vane for dividing the second space along a circumferential direction of the second piston, the third vane being attached to the second cylinder at a third angular position along the rotation direction of the shaft;

a fourth vane for further dividing the second space divided by the third vane so that a third compression chamber and a fourth compression chamber having a smaller volume than the third compression chamber are formed within the second cylinder, the fourth vane being attached to the second cylinder at a fourth angular position along the rotation direction of the shaft;

a third suction port for introducing the working fluid to be compressed in the third compression chamber into the third compression chamber;

a third discharge port for discharging the working fluid compressed in the third compression chamber outside the third compression chamber from the third compression chamber;

a fourth suction port for introducing the working fluid to be compressed in the fourth compression chamber into the fourth compression chamber;

a fourth discharge port for discharging the working fluid compressed in the fourth compression chamber outside the fourth compression chamber from the fourth compression chamber; and a second suction check valve provided in the fourth suction port.

11. The rotary compressor according to claim 10, wherein the fourth compression chamber has a larger volume than the second compression chamber.

12. The rotary compressor according to claim 8, wherein the shaft includes a first eccentric portion to which the first piston is fitted and a second eccentric portion to which the second piston is fitted, and an angular difference between a direction in which the first eccentric portion projects and a direction in which the second eccentric portion projects is 180 degrees in the rotation direction of the shaft.

13. A refrigeration cycle apparatus comprising:

the rotary compressor according to claim 1;

a radiator for cooling the working fluid compressed in the rotary compressor;

an expansion mechanism for expanding the working fluid cooled in the radiator;

a gas-liquid separator for separating the working fluid expanded in the expansion mechanism into a gas phase working fluid and a liquid phase working fluid;

an evaporator for evaporating the liquid phase working fluid separated in the gas-liquid separator;

a suction flow path for introducing the working fluid that has flowed out of the evaporator into the first suction port of the rotary compressor; and an injection flow path for introducing the gas phase working fluid separated in the gas-liquid separator into the second suction port of the rotary compressor.

14. The refrigeration cycle apparatus according to claim 13, wherein the rotary compressor is the rotary compressor according to claim 8, and the suction flow path includes a branch portion extending toward the first suction port and a branch portion extending toward the third suction port so that the working fluid that has flowed out of the evaporator is introduced into both the first suction port and the third suction port of the rotary compressor.

15. A refrigeration cycle apparatus comprising:

the rotary compressor according to claim 10;

a radiator for cooling the working fluid compressed in the rotary compressor;

a first expansion mechanism for expanding the working fluid cooled in the radiator;

a first gas-liquid separator for separating the working fluid expanded in the first expansion mechanism into a gas phase working fluid and a liquid phase working fluid;

a second expansion mechanism for expanding the liquid phase working fluid separated in the first gas-liquid separator;

a second gas-liquid separator for separating the working fluid expanded in the second expansion mechanism into a gas phase working fluid and a liquid phase working fluid;

an evaporator for evaporating the liquid phase working fluid separated in the second gas-liquid separator;

a suction flow path for introducing the working fluid that has flowed out of the evaporator into each of the first suction port and the third suction port of the rotary compressor;

a first injection flow path for introducing the gas phase working fluid separated in the first gas-liquid separator into the second suction port of the rotary compressor; and a second injection flow path for introducing the gas phase working fluid separated in the second gas-liquid separator into the fourth suction port of the rotary compressor.

16. The rotary compressor according to claim 7, wherein the groove is formed in the cylinder so as to extend outwardly in a radial direction of the cylinder.

* * * * *